US009526383B2

(12) United States Patent
Delaney et al.

(10) Patent No.: US 9,526,383 B2
(45) Date of Patent: Dec. 27, 2016

(54) SECONDARY DISPENSER METHOD AND APPARATUS

(71) Applicant: Bob's Butt Wipes, L.L.C., Slidell, LA (US)

(72) Inventors: Robert Delaney, Slidell, LA (US); Christopher Montgomery, Mandeville, LA (US); Donald Scott Rogers, Lafayette, LA (US); Billy James McDonald, Lafayette, LA (US)

(73) Assignee: Sterling Global Products, LLC, Slidell, LA (US)

( * ) Notice: Subject to any disclaimer, the term of this patent is extended or adjusted under 35 U.S.C. 154(b) by 279 days.

(21) Appl. No.: 13/795,236

(22) Filed: Mar. 12, 2013

(65) Prior Publication Data

US 2014/0124525 A1 May 8, 2014

Related U.S. Application Data

(63) Continuation-in-part of application No. 29/436,531, filed on Nov. 7, 2012, now Pat. No. Des. 688,063.

(51) Int. Cl.

| | |
|---|---|
| ***A47K 10/42*** | (2006.01) |
| ***A47K 10/38*** | (2006.01) |
| *A47K 10/32* | (2006.01) |

(52) U.S. Cl.

CPC ..... *A47K 10/38* (2013.01); *A47K 2010/326* (2013.01); *A47K 2010/3266* (2013.01)

(58) Field of Classification Search

USPC ..... 221/34, 45, 92, 282, 283

See application file for complete search history.

(56) References Cited

U.S. PATENT DOCUMENTS

| | | | | |
|---|---|---|---|---|
| 2,685,365 | A * | 8/1954 | Sieven | 206/410 |
| 8,550,296 | B2 * | 10/2013 | Gerschwiler Steck et al. | 221/283 |
| 2004/0124203 | A1 * | 7/2004 | Phelps et al. | 221/34 |
| 2007/0221778 | A1 * | 9/2007 | Gullo | 242/598.6 |
| 2008/0067185 | A1 * | 3/2008 | Schlaupitz et al. | 221/45 |
| 2008/0169411 | A1 * | 7/2008 | Quinn et al. | 248/691 |
| 2010/0096402 | A1 * | 4/2010 | Collado | 221/45 |
| 2010/0243669 | A1 * | 9/2010 | Rapala | 221/45 |

* cited by examiner

*Primary Examiner* — Gene Crawford
*Assistant Examiner* — Kelvin L Randall, Jr.
(74) *Attorney, Agent, or Firm* — Garvey, Smith, Nehrbass & North LLC; Brett A. North

(57) ABSTRACT

A secondary dispenser readily attachable to a standard toilet-tissue dispenser of a roll type for positioning next to the primary toilet-tissue dispenser for dispensing supplemental materials such as pre-wetted toilet sheets. The sheets can be withdrawn from an open door.

A compact auxiliary device providing wetted or self-wetting sheets for releasable proximate mounting in conjunction with a conventional toilet-tissue dispenser of dry sheets; comprises an inexpensive container or magazine component pre-loaded with the supplemental sheets. The magazine can be snapped into functional position rapidly. It serves an improved health care and cleanliness function.

18 Claims, 23 Drawing Sheets

FIG. 20
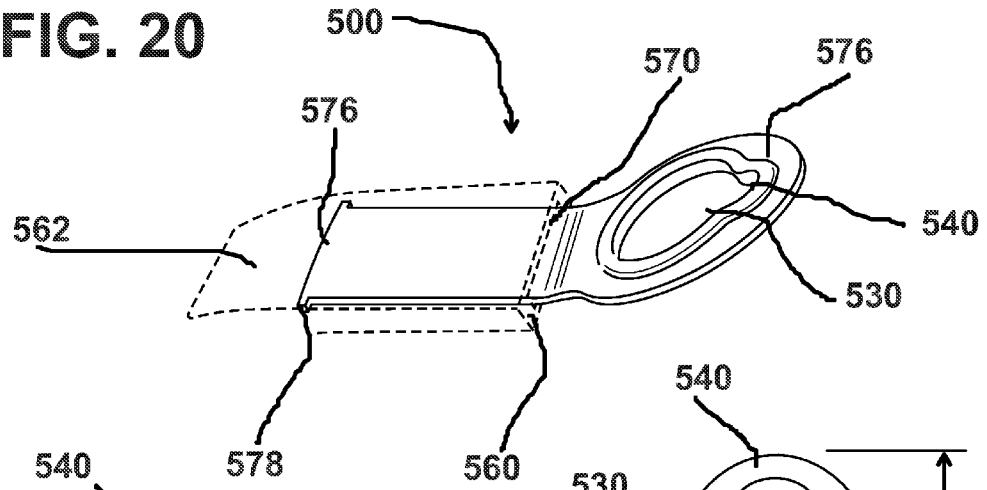
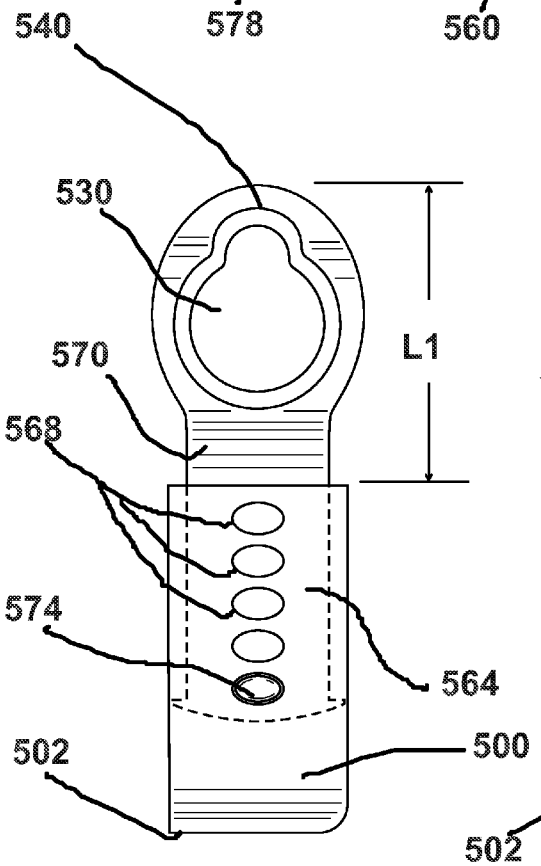
FIG. 21
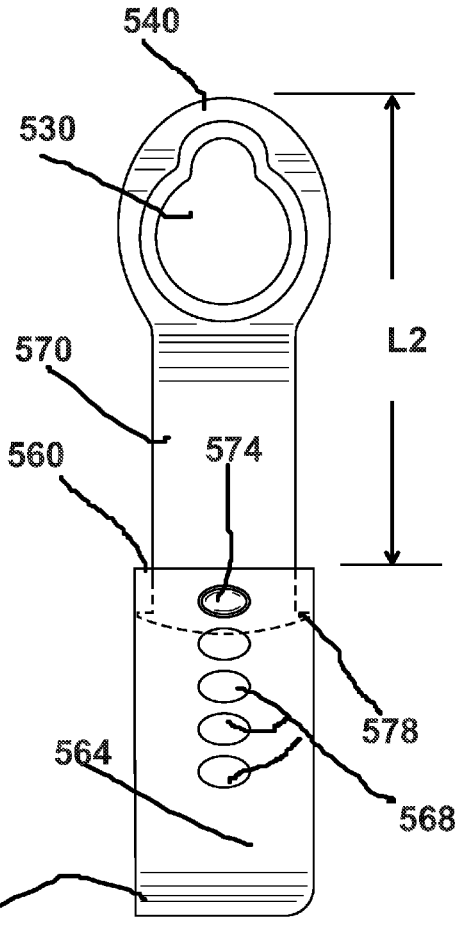
FIG. 22

SECONDARY DISPENSER METHOD AND APPARATUS

CROSS-REFERENCE TO RELATED APPLICATIONS

This application is a continuation in part of U.S. design patent application Ser. No. 29/436,531, filed Nov. 7, 2012, which application is incorporated herein by reference and priority of/to which application is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Dispensing of toilet tissue in roll form is well known in the art. Typical dispensers for tissue rolls generally include a base that is attached to a wall or other supporting surface, and support arms that extend transversely from the base. A spindle is inserted through the roll and engaged in recesses or divots at the ends of the support arms.

Numerous dispensers have been developed in the art specifically for dispensing stacked individual tissue sheets. Such dispensers typically permit the user to remove any number of sheets one at a time in a manner such that the adjacent sheet is presented for easy grasping and removal from the dispenser. Efforts have been made to incorporate such dispensers with existing conventional rolled product dispensing fixtures so that the dispenser need not be separately mounted.

One embodiment provides an improved folded tissue sheet dispenser adapted for configuration with conventional roll product dispensing fixtures.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a improved folded tissue sheet dispenser adapted for configuration with conventional roll product dispensing fixtures.

One embodiment provides a supplemental sheet dispenser compatible with conventional toilet paper dispensing systems.

One embodiment provides a supplemental sheet dispenser wherein the sheets may be pre-wetted and supplied in substantially sealed container with sealable access door. In one embodiment the container can include extendable connecting arms which can detachably connect to a conventional toilet paper dispenser. One embodiment provides a dispenser for dry sheets which can be wetted by a liquid added to the container component by the user or consumer.

In one embodiment is provided a supplemental dispenser for detachably mounting on a conventional toilet paper dispenser, the apparatus having a container component adapted to accept or pre-loaded with wetted, self-wetting or wettable sheet material.

In one embodiment is provided releasable attachment mechanism for the container housing for detachably mounting on a conventional toilet paper dispenser.

In one embodiment is provided a detachable mount having extendable arms for attachment of the container conventional toilet-tissue dispenser to releasably engage a toilet-tissue supporting spindle of the dispenser.

One embodiment provides a supplementary dispenser configured for dispensing a supply of folded tissues from a dispenser fixture that has extendable and retractable support arms. The fixture may be, for example, a conventional tissue roll dispenser wherein the support arms include a opening at their ends into which the ends of a spindle are received. The spindle is typically inserted through a core or hollow member provided in the bathroom tissue roll.

The dispenser includes a housing container having an internal compartment volume configured to retain a supply of folded issue sheets. The housing is not limited to any particular style, configuration, or shape, and may take on any aesthetically pleasing configuration and be made of any conventional material.

In one embodiment, the housing is an elongated box-like structure. The housing may be refillable, or can be a disposable item to be discarded after depletion of the tissue supply. It should also be appreciated that the dispenser is not limited to any particular type of product to be dispensed, but is particularly well suited for dispensing a stack of interfolded tissue sheets. The tissue sheets may be dry or pre-moistened.

A dispensing opening is defined in a wall of the housing. The opening may be, for example, a door in a top surface, bottom surface, or side surface of the housing. The opening provides a location for a consumer to easily access, grasp, and pull individual tissue sheets from the dispenser.

Retractable and extendable support arms can be provided on opposed exterior side walls of the container housing. Each support arm can include an opening with a shape and configuration for engagement with a portion of a spindle.

In one embodiment the support arms can be extendable and retractable in positions along their respective tracks allowing the container housing to be adaptable with different fixtures having varying length support arms along with allowing the container housing to provide frictional resistance to the roll of toilet paper. In one particular embodiment, the support arms are variably positionable along their tracks. In one embodiment a releasable engagement mechanism is provided between each support arm and the container housing, which can include a ratcheting mechanism such as a resiliently mounted positioning button which can be connected to one of a plurality of positioning openings disposed along each arms length.

In one embodiment the extension member may be resiliently biased towards the openings. Any configuration of engaging members operatively disposed between the slide member and position bar may be used. In an alternate embodiment, each arm may be frictionally retained in position relative to the track.

In one embodiment the dispenser may also include a supply of folded tissues disposed within the container housing. The container housing may be openable and refillable with a cartridge of tissues in the form of, for example, a bag or pouch-like container insertable into the housing.

In one embodiment is provided a container including an openable door (a) when closed is hermetically seals the interior volume of the container, and (b) when opened provides access to at least one sheet of a plurality of sheets. In one embodiment the door is pivotally connected to the container (e.g. hingedly connected).

In one embodiment a basic liquid employed as above described may, for example, be largely a distilled sterile water, water and alcohol, or water, alcohol and an emollient such as lanolin. A fragrance may also be included. Other possible ingredients comprise a humectant, e.g., glycerine or propylene glycol, an appropriate antiseptic or germicidal substance, or a bacteriostat, a mineral oil, an emulsifying agent and a stabilizing agent. While a liquid as, for example, a liquid having a cleansing and sterilizing property may be used, the sheets may alternatively use a treating agent such as a powder, a salve, a cream or the like.

In one embodiment the wetted sheets have an adequate tear strength to withstand withdrawal from the container and such sheets they may multilayered.

In one embodiment the container and its components are comprised of plastic composition, e.g., a thermoplastic such as polystyrene, polypropylene, a polycarbonate, ABS, etc., and are formed, for example, by an injection molding method.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 20 is a schematic view of one of the arms shown in FIG. 19 taken from the external side of the arm.

FIG. 21 is a side view of the arm of FIG. 20 taken from the internal side, where the arm is in a retracted position and locked in place in such retracted position.

FIG. 22 is a side view of the arm of FIG. 20 taken from the internal side, where the arm is in an extended position and locked in place in such extended position.

DETAILED DESCRIPTION

Figure 1:
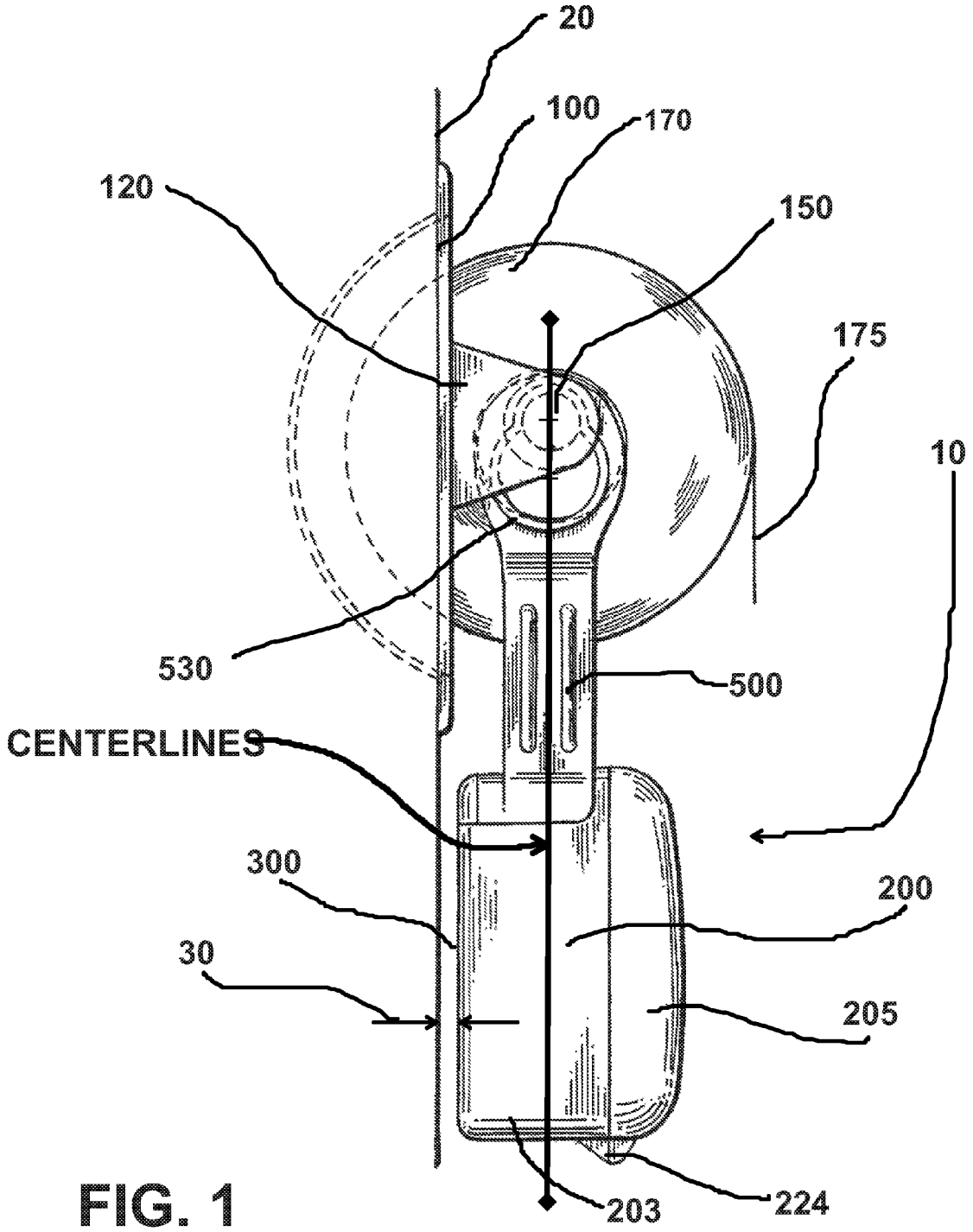
FIG. 1 is a side view of a supplemental dispenser with folding arms attached to and hanging vertically from a spindle of a toilet paper dispenser.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Referring to the figures in general, in one embodiment is provided a supplementary dispenser 10 is provided for storing and dispensing folded tissue sheets 250 from a toilet paper dispenser 100, the supplemental dispenser 10 having extending and retracting support arms 400,500, a container 200, and an interior volume 210.

Figure 2:
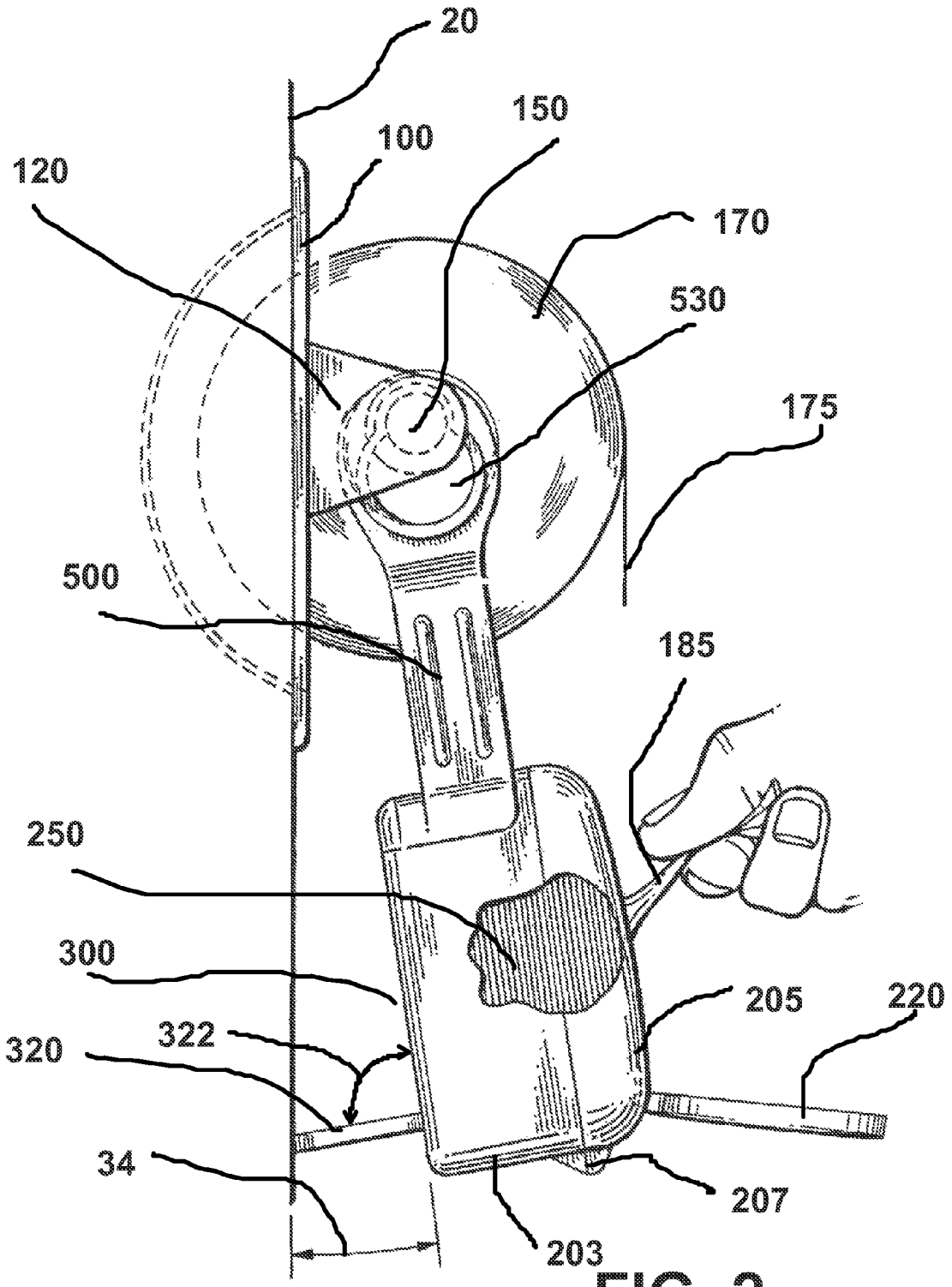
FIG. 2 shows a side view of the dispenser of FIG. 1 with the rear support now extended causing the dispenser to make a non vertical angle from a wall, and a user selecting a wipes from the dispenser when having the option of also selecting toilet paper from a toilet paper roll.

FIG. 2 is a side view of supplemental dispenser 200 with folding arms 400,500 attached to and hanging from a spindle 150 of a toilet paper dispenser 100, and a positioning bracket 300 being opened (indicated by angle 322) to place the dispenser container 200 in a non vertical position relative to the wall as schematically indicated by angle 34. Positioning bracket 320 can be pivotally connected to container 200. Container 200 can include recess 310 to that, when closed, positioning bracket 320 is substantially if not completely recessed relative to bottom 300 of container.

Figure 3:
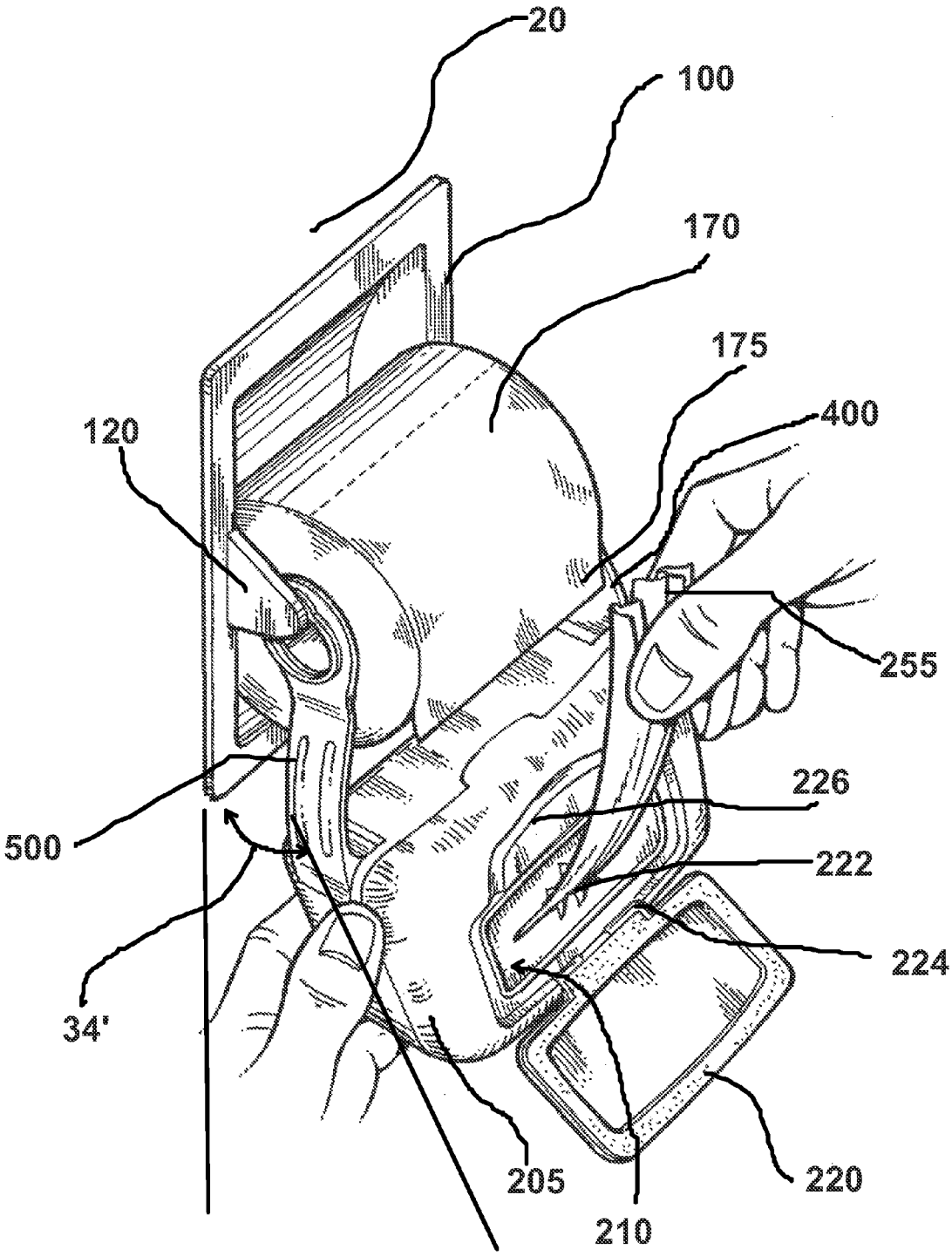
FIG. 3 shows a perspective view of the dispenser of FIG. 1 with the door opened and a user pulling a wipe from the dispenser.
Figure 4:
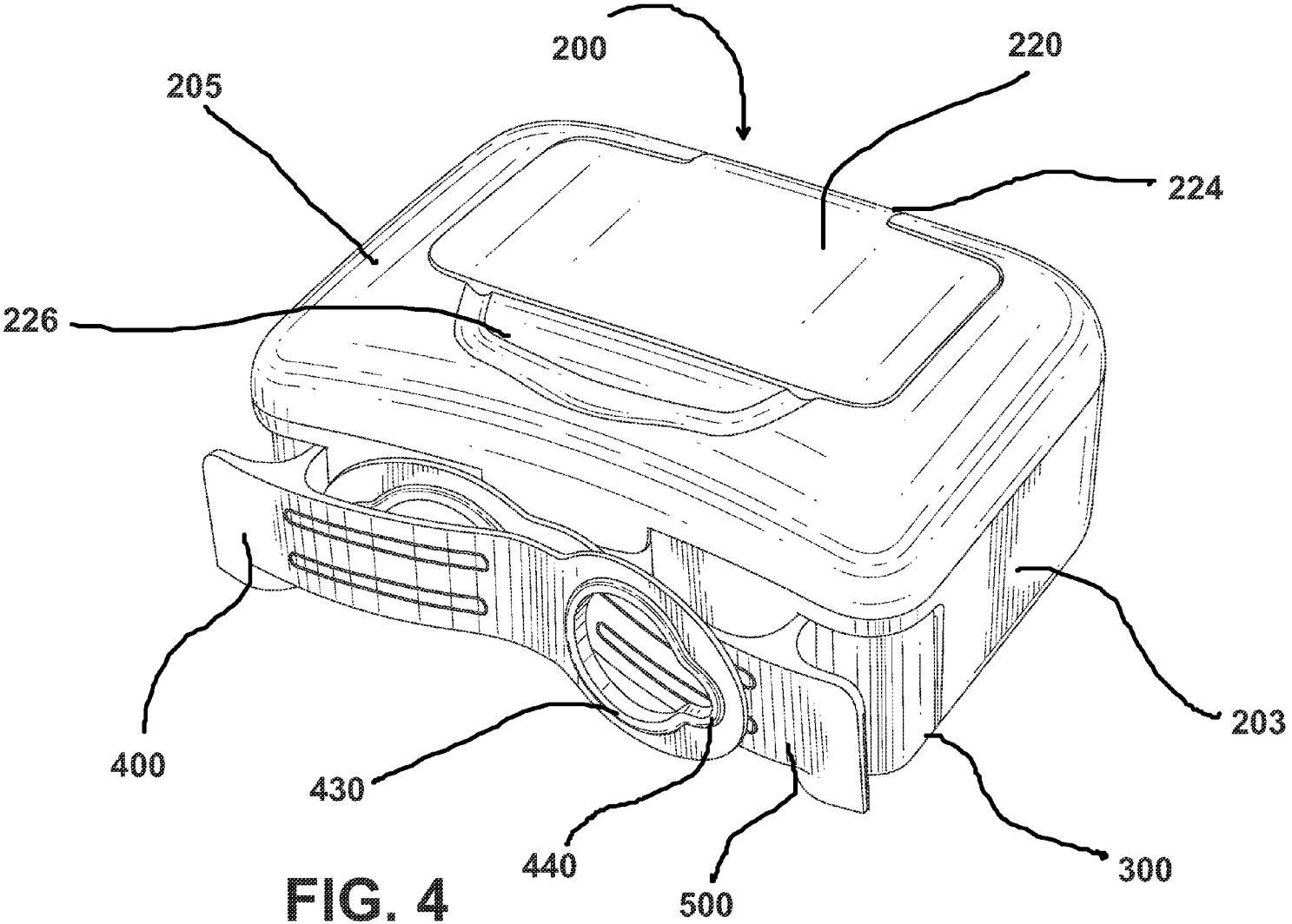
FIG. 4 is an upper front perspective view dispenser of FIG. 1 with the support arms collapsed with upper lid and middle section closed.
Figure 5:
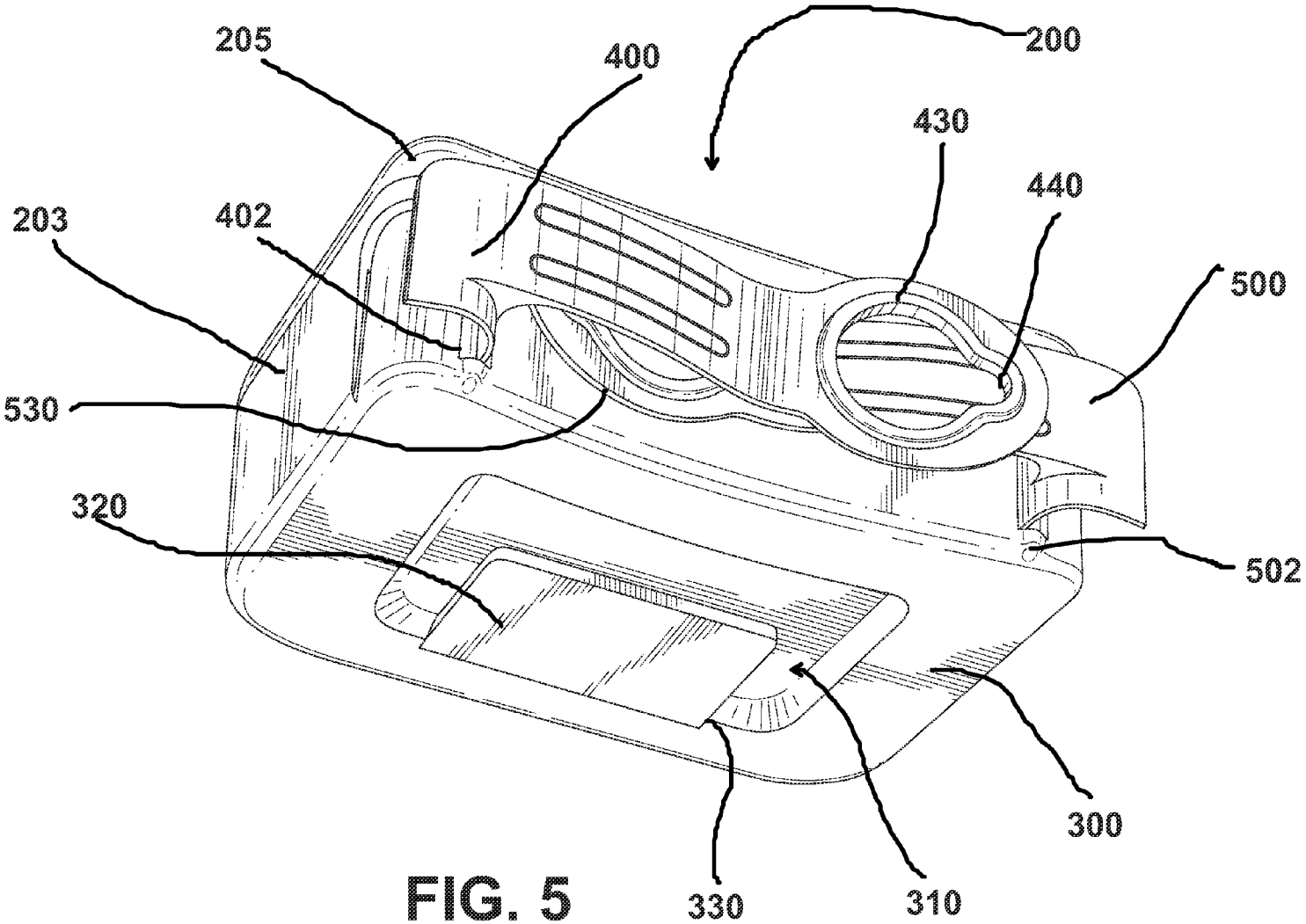
FIG. 5 is a lower front view dispenser of FIG. 1 with the support arms collapsed with upper lid and middle section closed.
Figure 6:
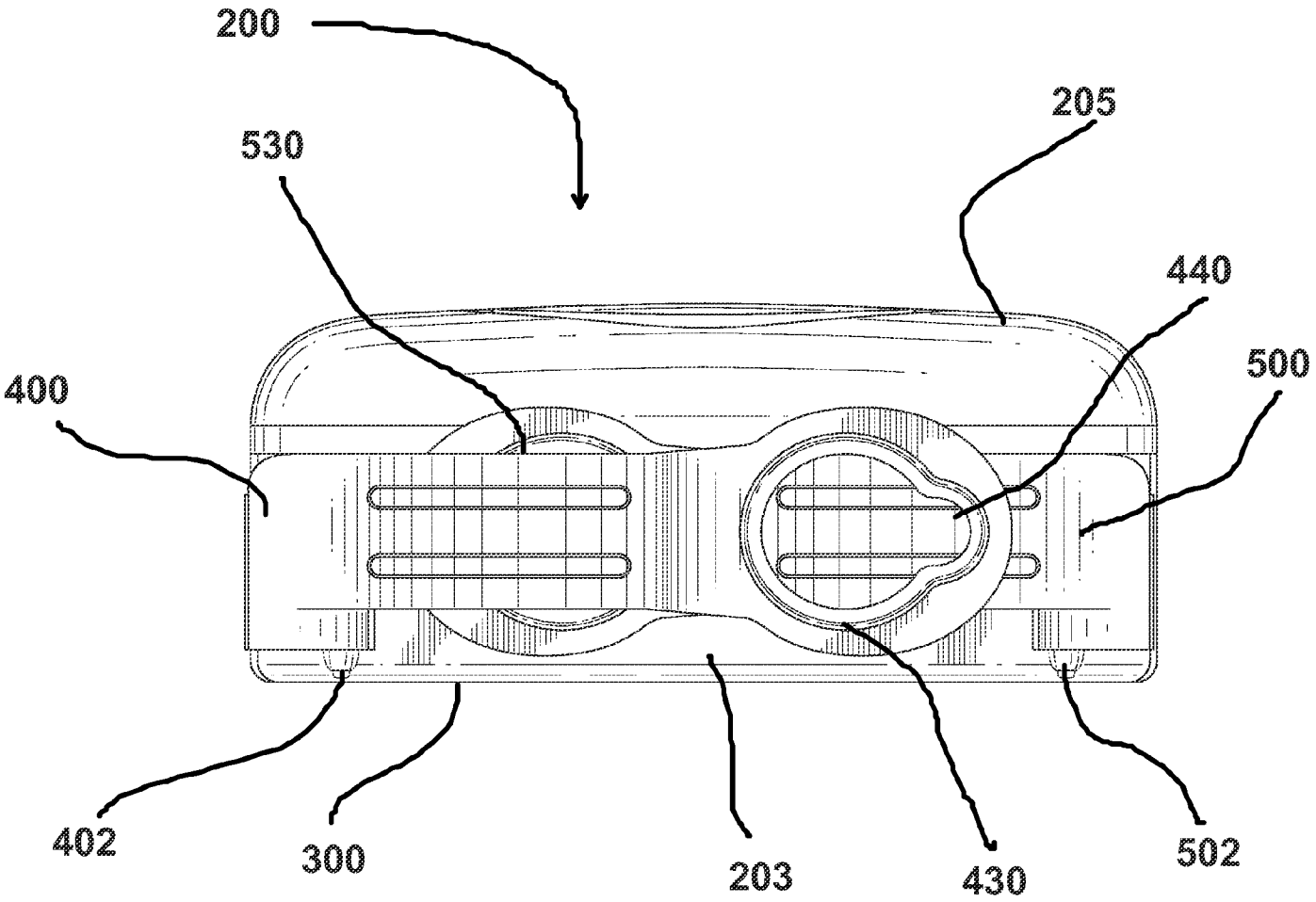
FIG. 6 is a front view dispenser of FIG. 1 with the support arms collapsed with upper lid and middle section closed.
Figure 7:
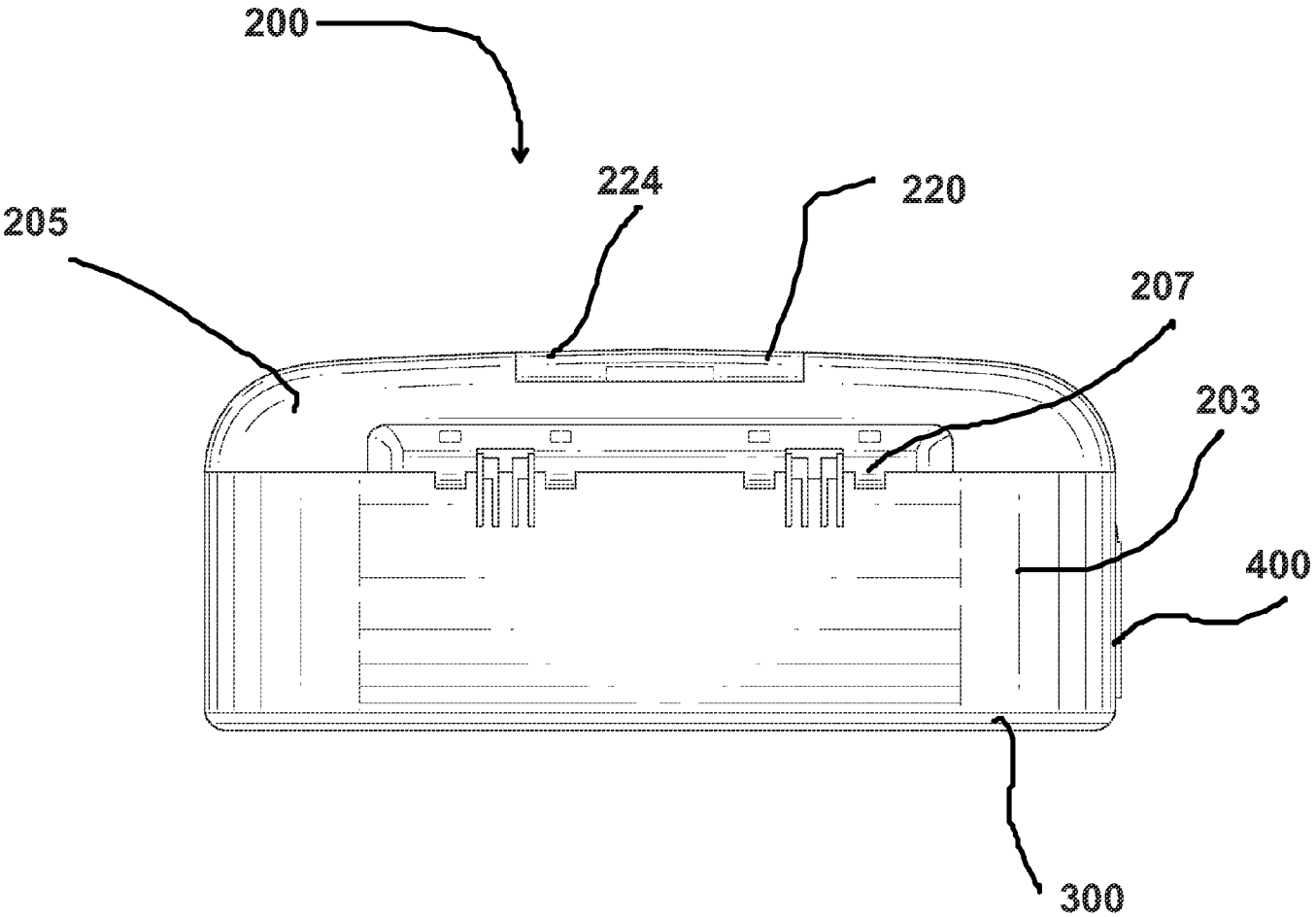
FIG. 7 is a rear view dispenser of FIG. 1 with the support arms collapsed with upper lid and middle section closed.
Figure 8:
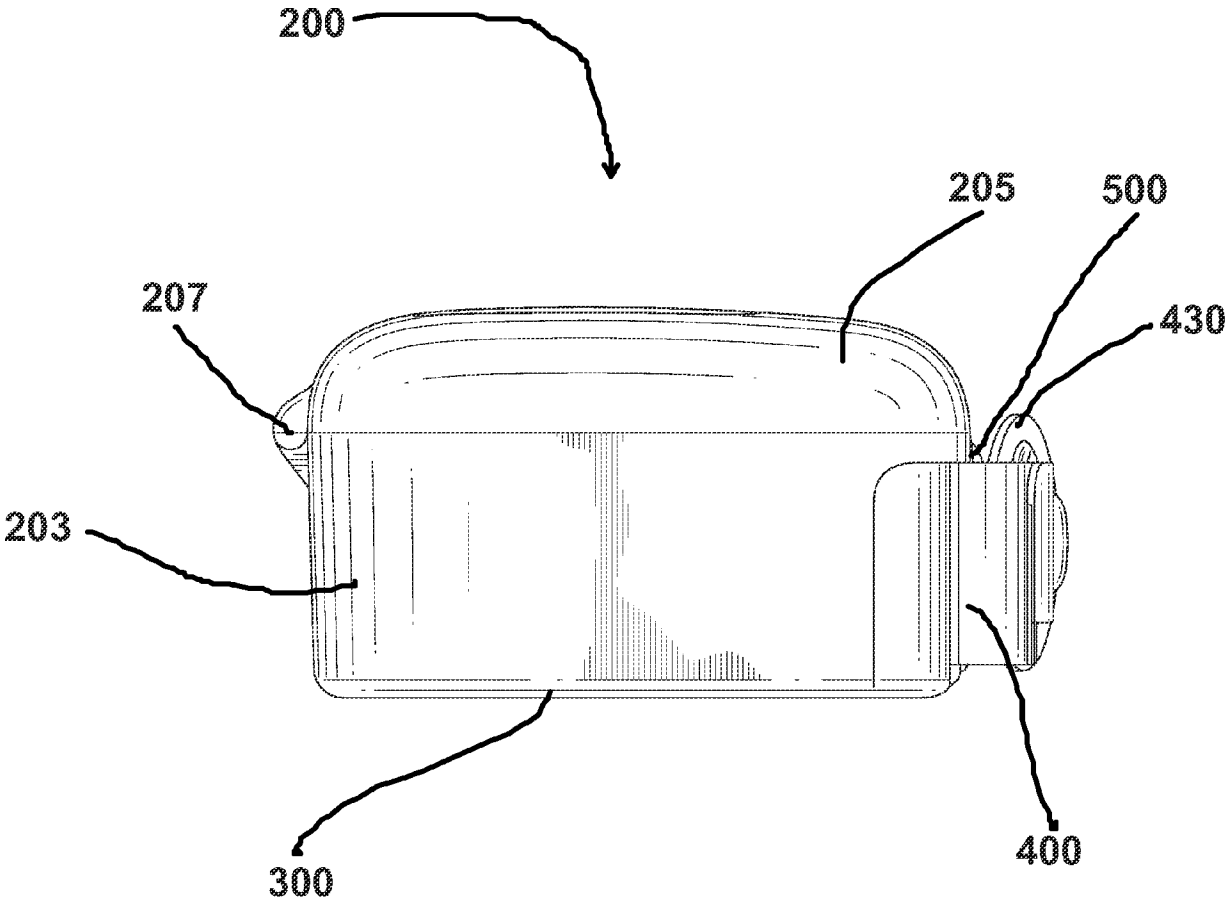
FIG. 8 is a left side view dispenser of FIG. 1 with the support arms collapsed with upper lid and middle section closed.
Figure 9:
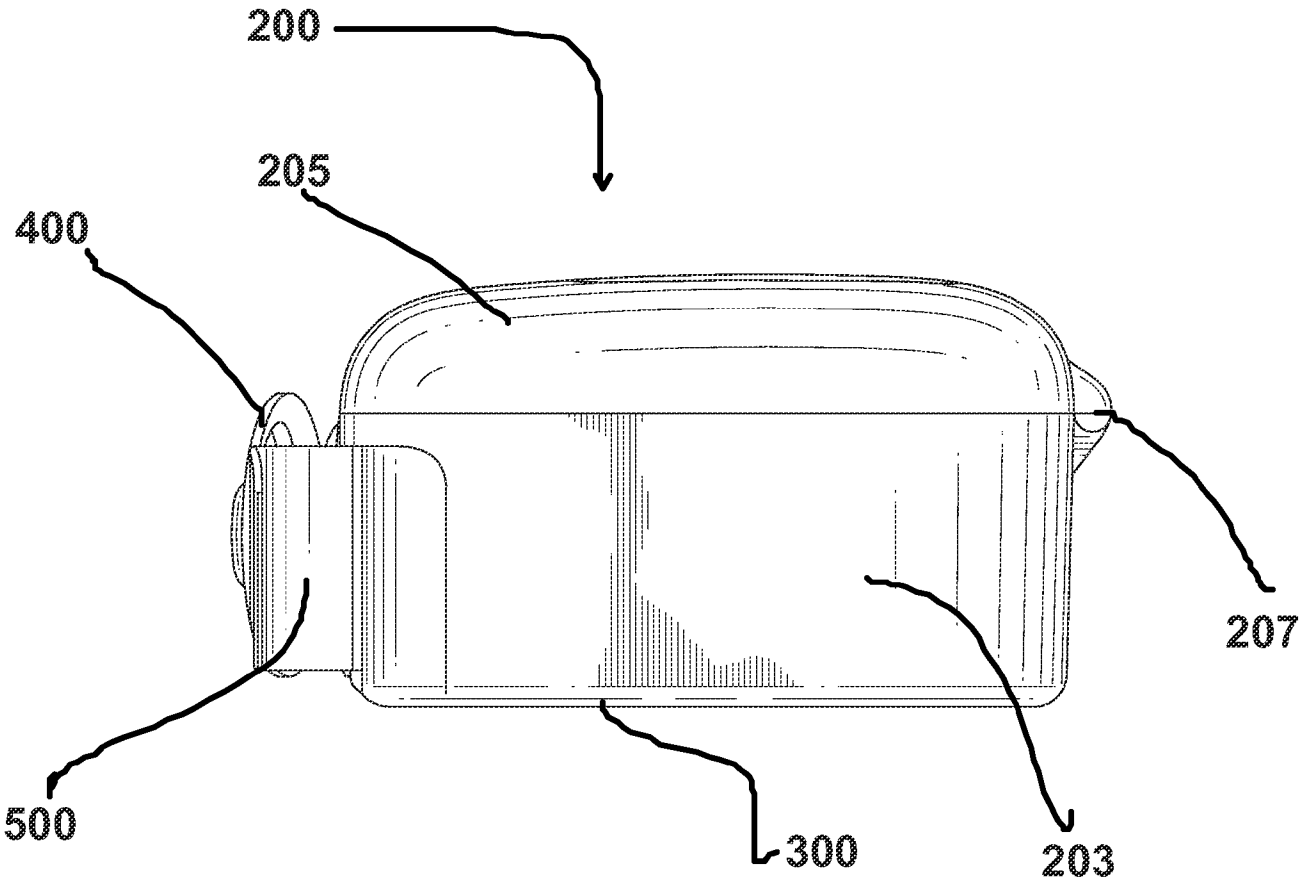
FIG. 9 is a right side view dispenser of FIG. 1 with the support arms collapsed with upper lid and middle section closed.
Figure 10:
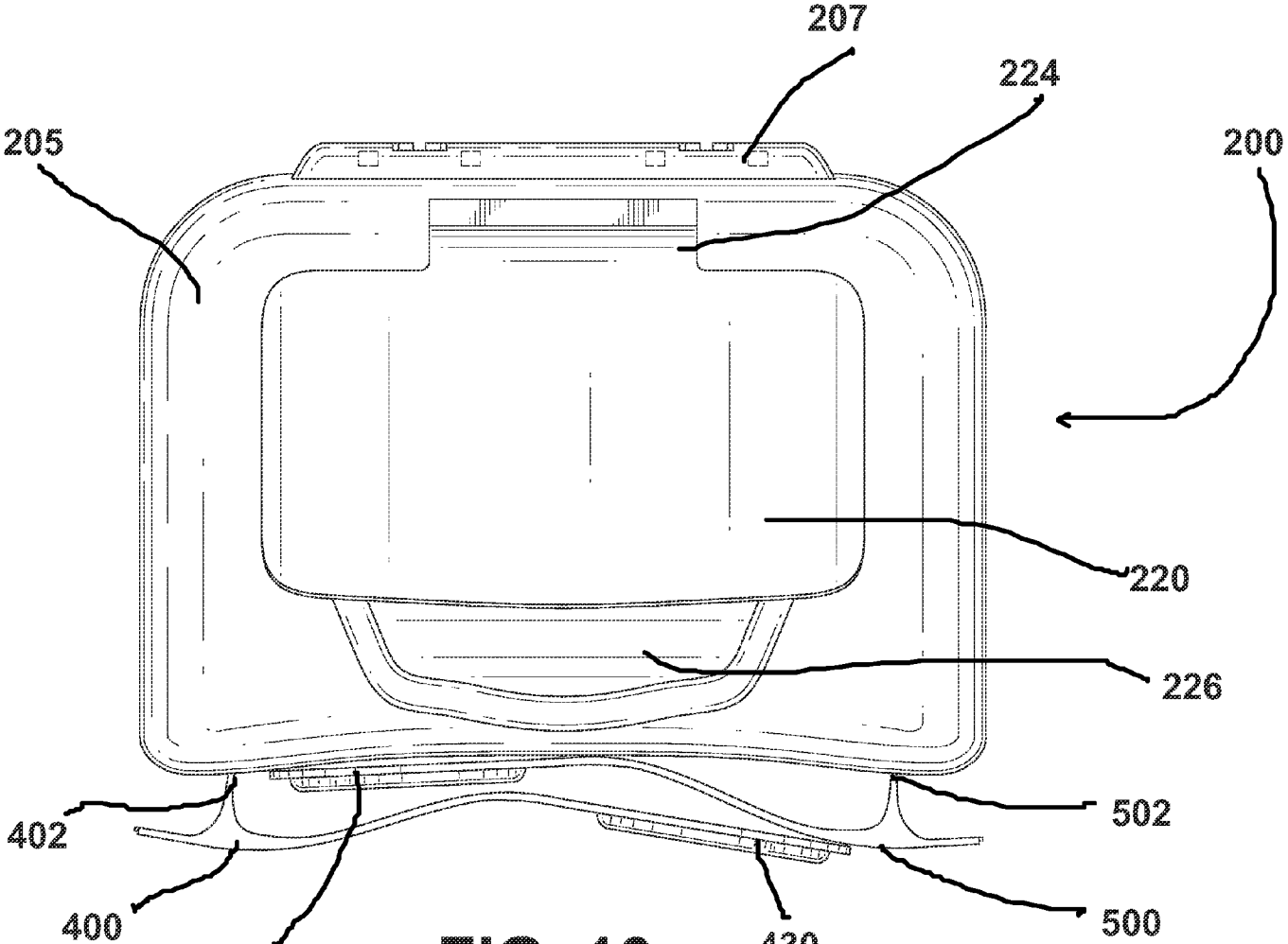
FIG. 10 is a top view dispenser of FIG. 1 with the support arms collapsed with upper lid and middle section closed.
Figure 11:
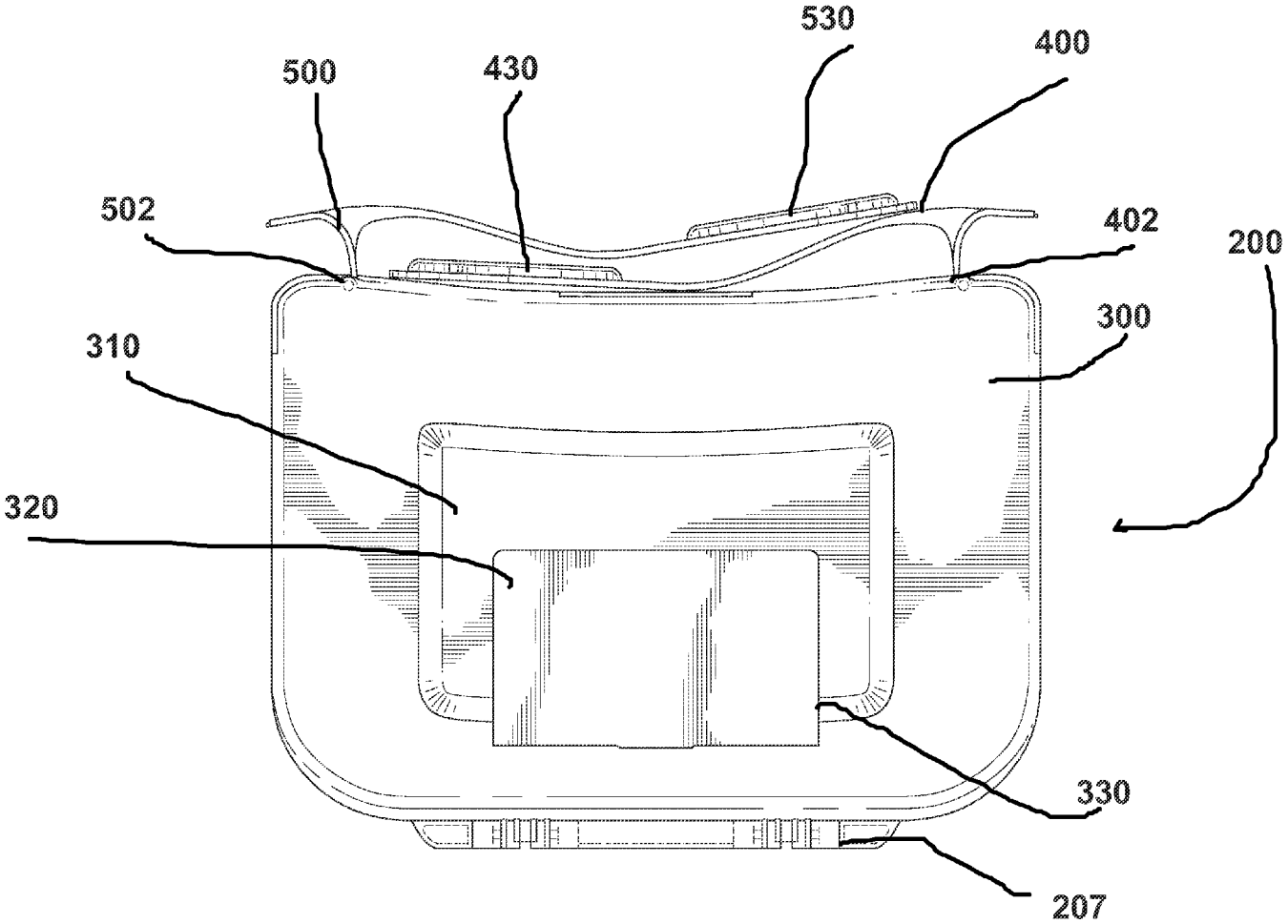
FIG. 11 is a bottom view dispenser of FIG. 1 with the support arms collapsed with upper lid and middle section closed.
Figure 12:
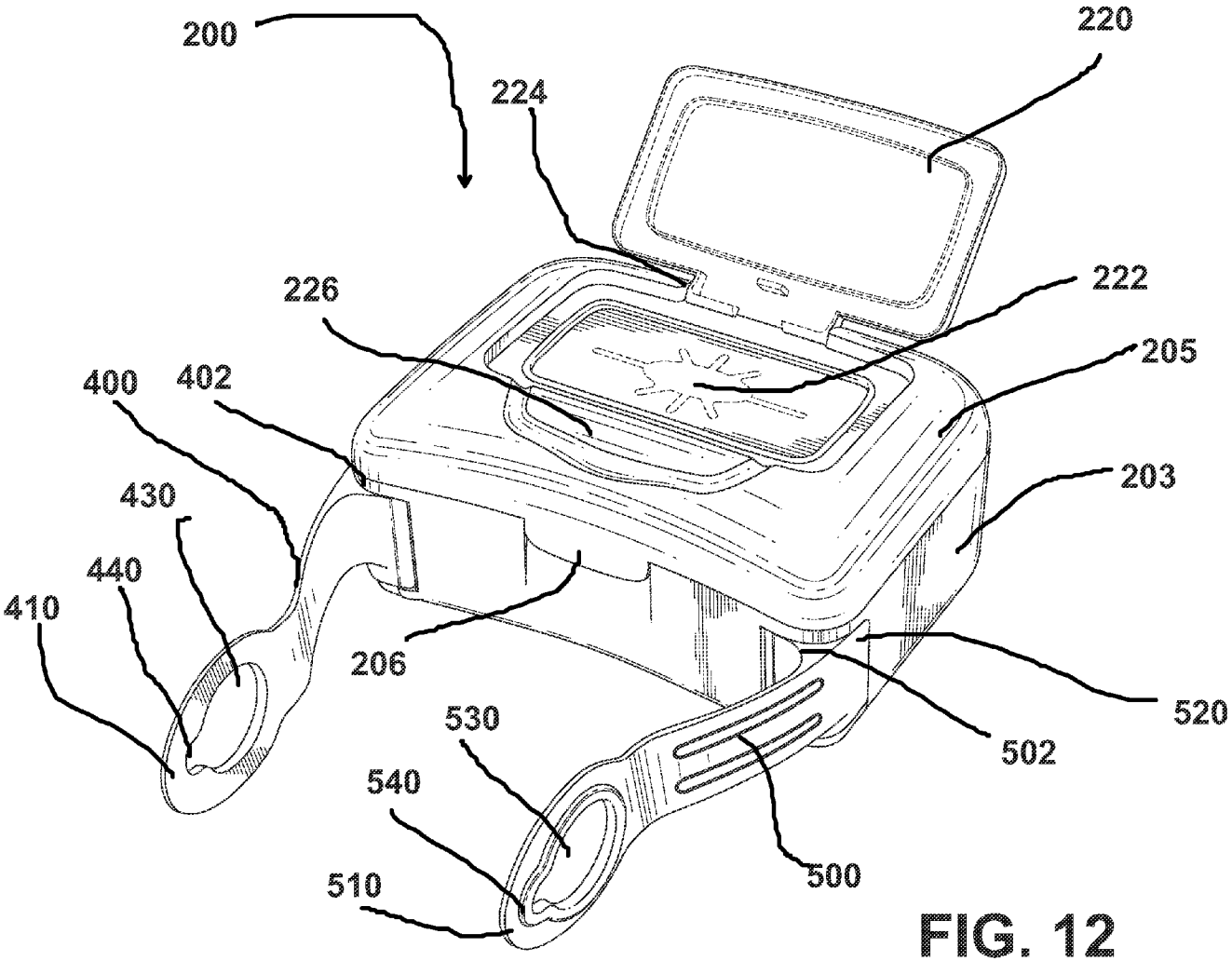
FIG. 12 is an upper front perspective view dispenser of FIG. 1 with the support arms folded/pivoted out with upper lid open and middle section closed.
Figure 13:
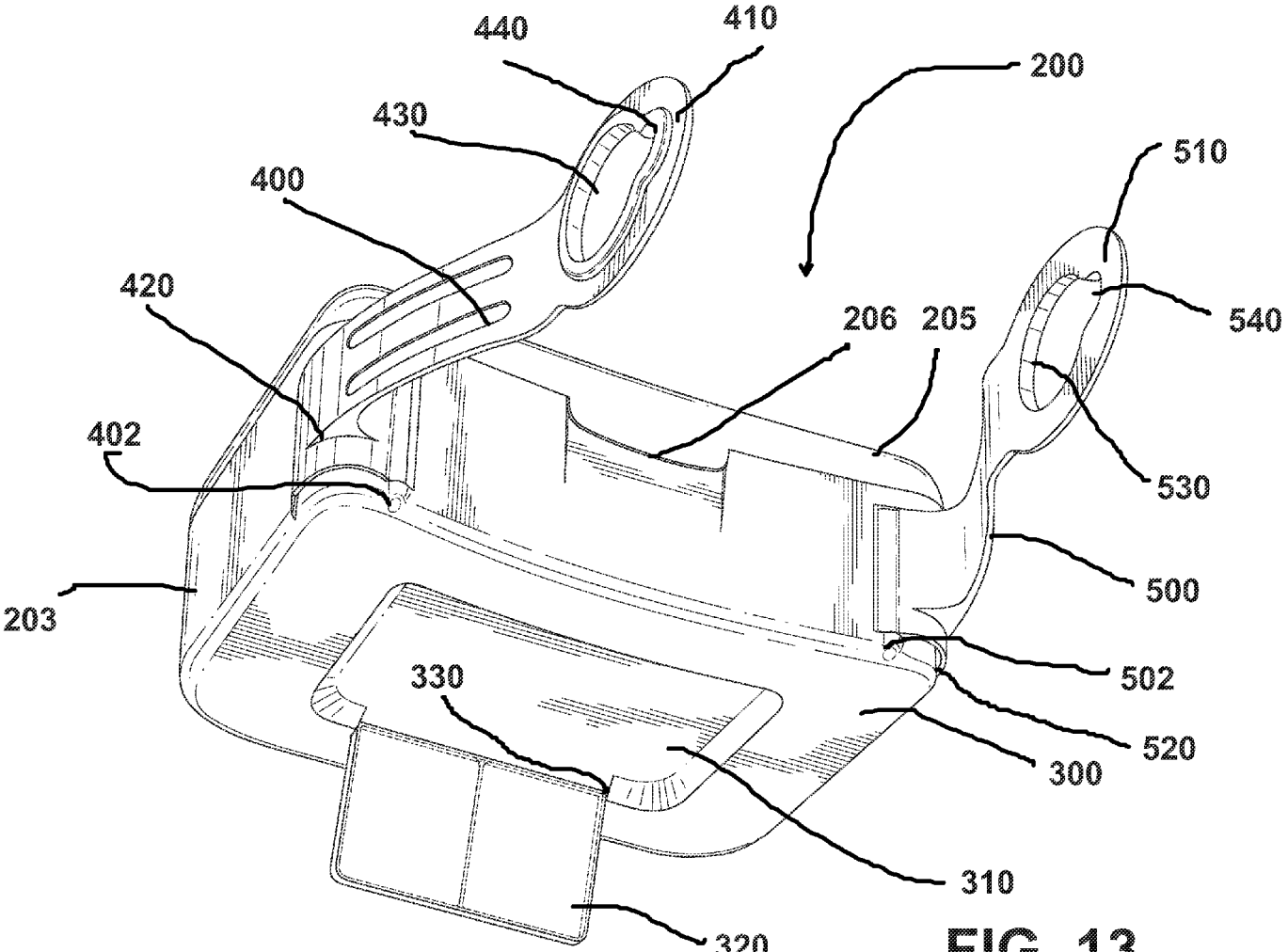
FIG. 13 is a lower front view dispenser of FIG. 1 with the support arms folded/pivoted out and lower spacer extended.
Figure 14:
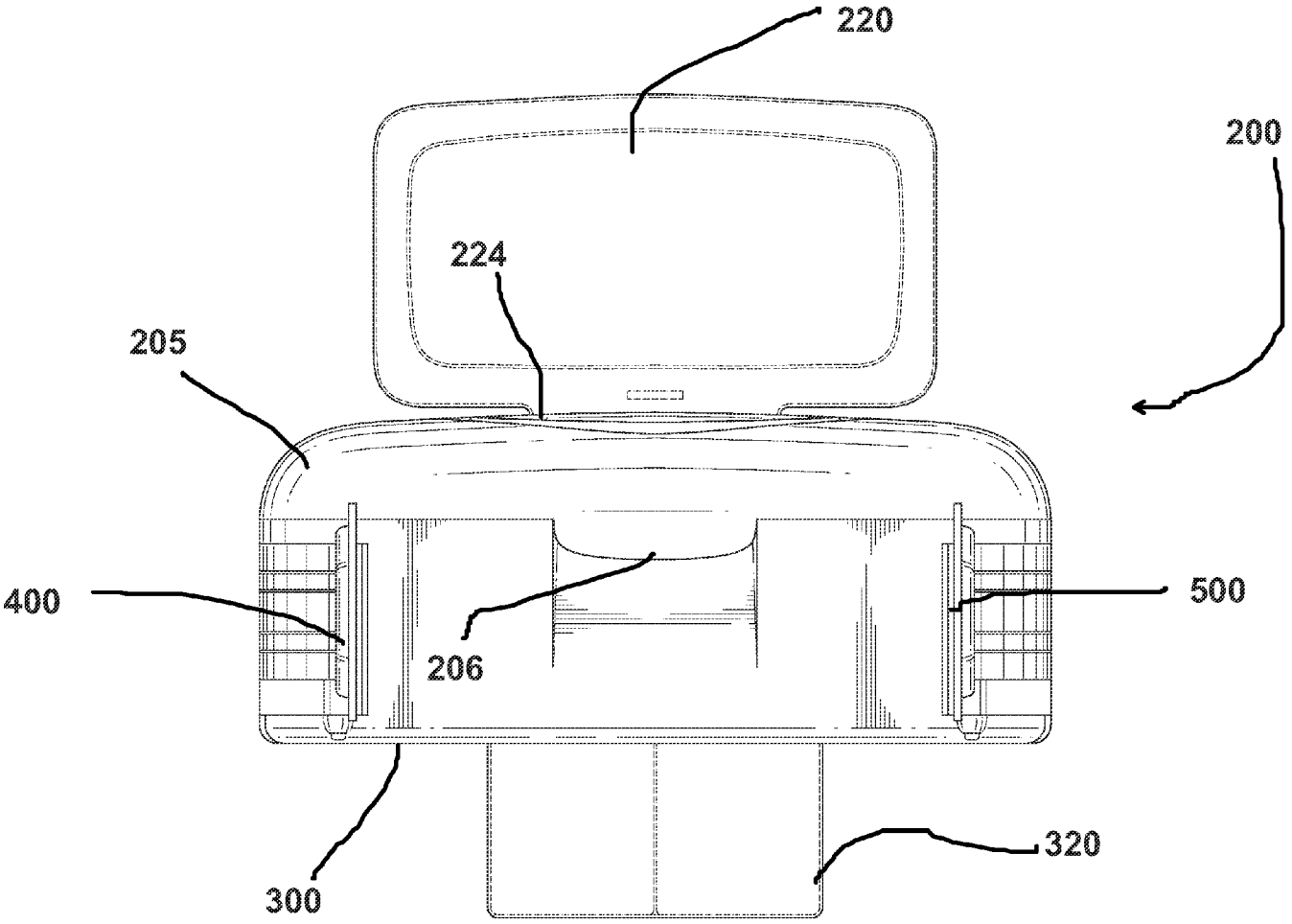
FIG. 14 is a front view dispenser of FIG. 1 with the support arms folded/pivoted out with upper lid open and middle section closed, and lower spacer pivoted out/extended.
Figure 15:
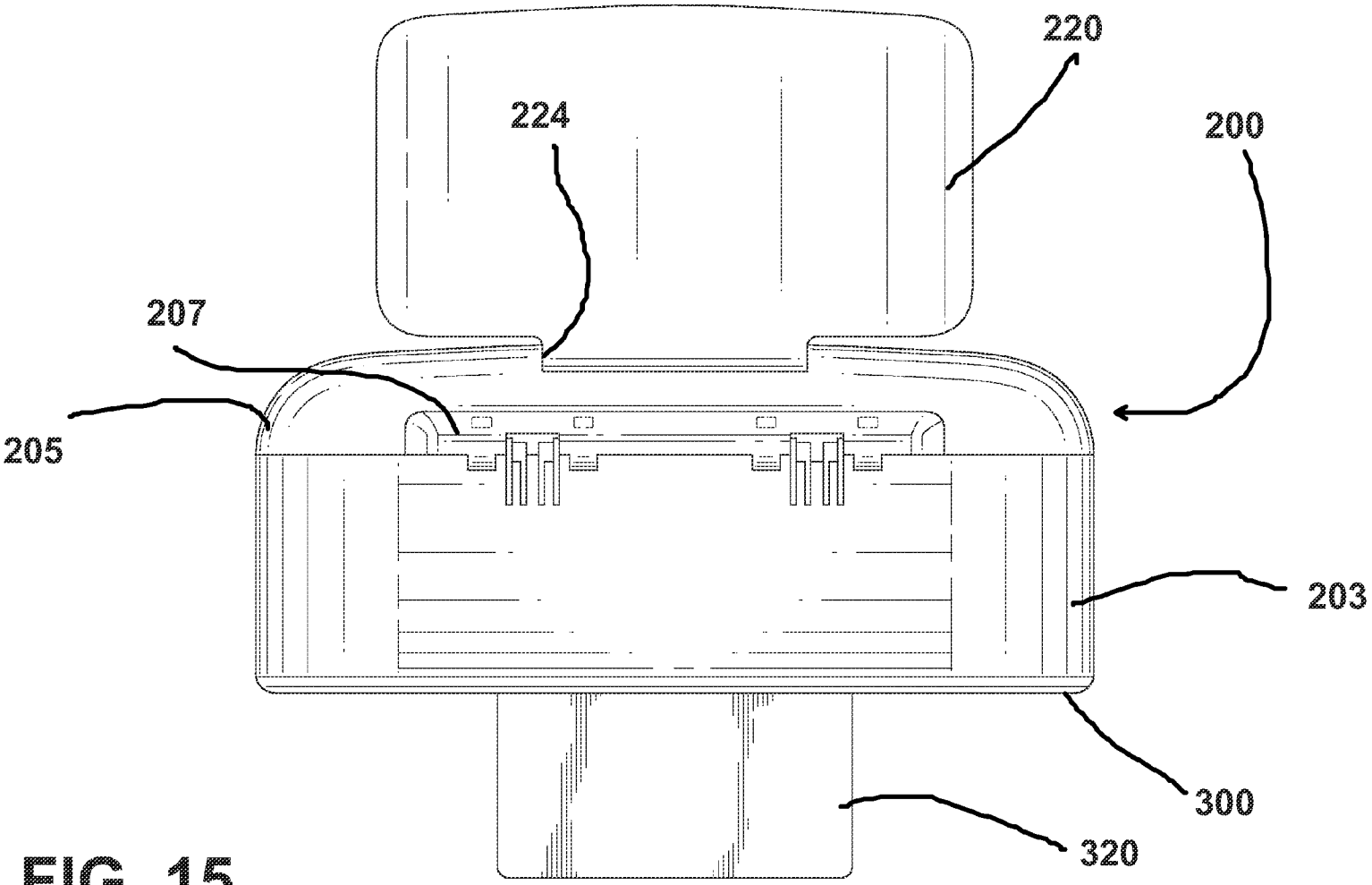
FIG. 15 is a rear view dispenser of FIG. 1 with the support arms folded/pivoted out with upper lid open and middle section closed, and lower spacer pivoted out/extended.
Figure 16:
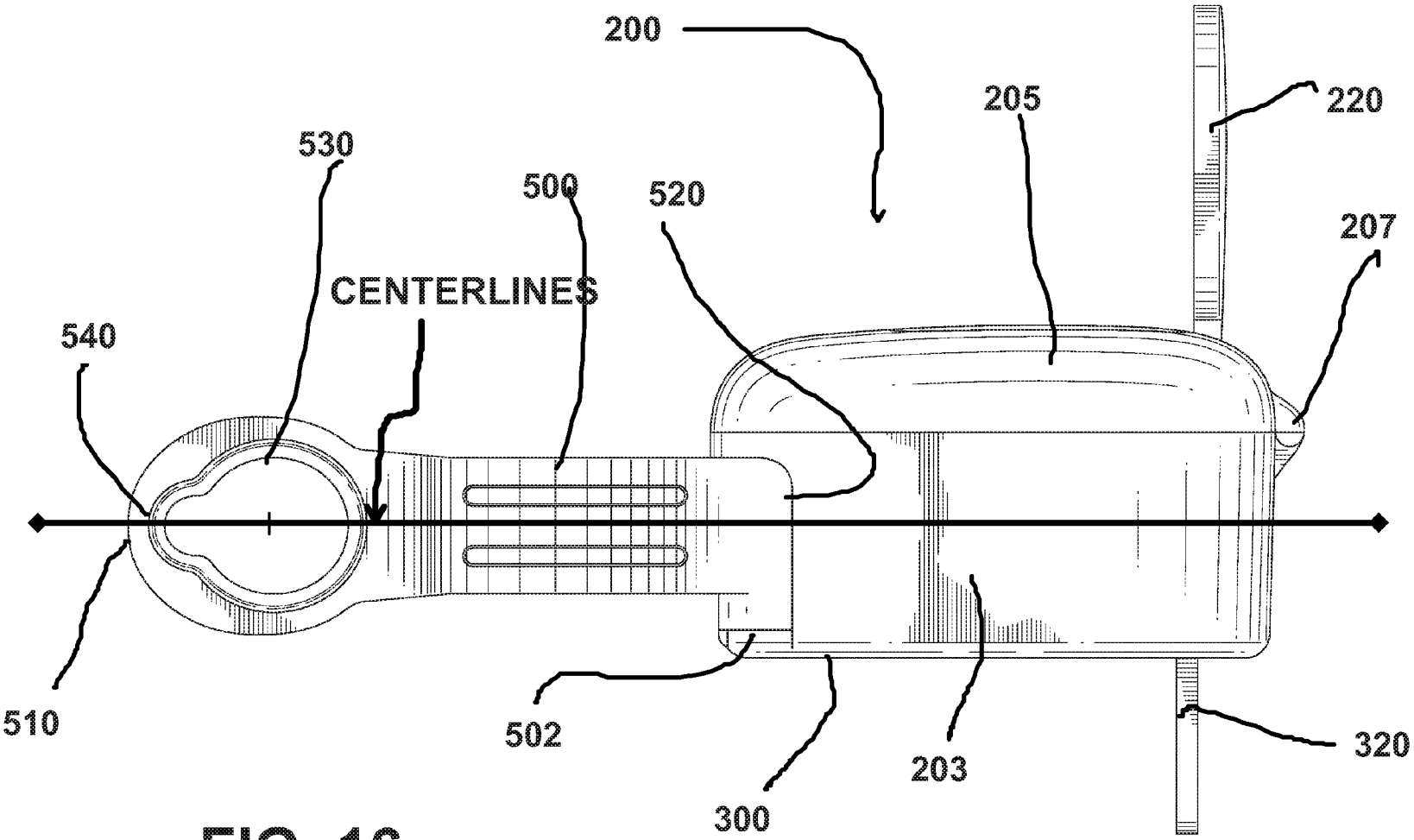
FIG. 16 is a right side view dispenser of FIG. 1 with the support arms folded/pivoted out with upper lid open and middle section closed, and lower spacer pivoted out/extended.
Figure 17:
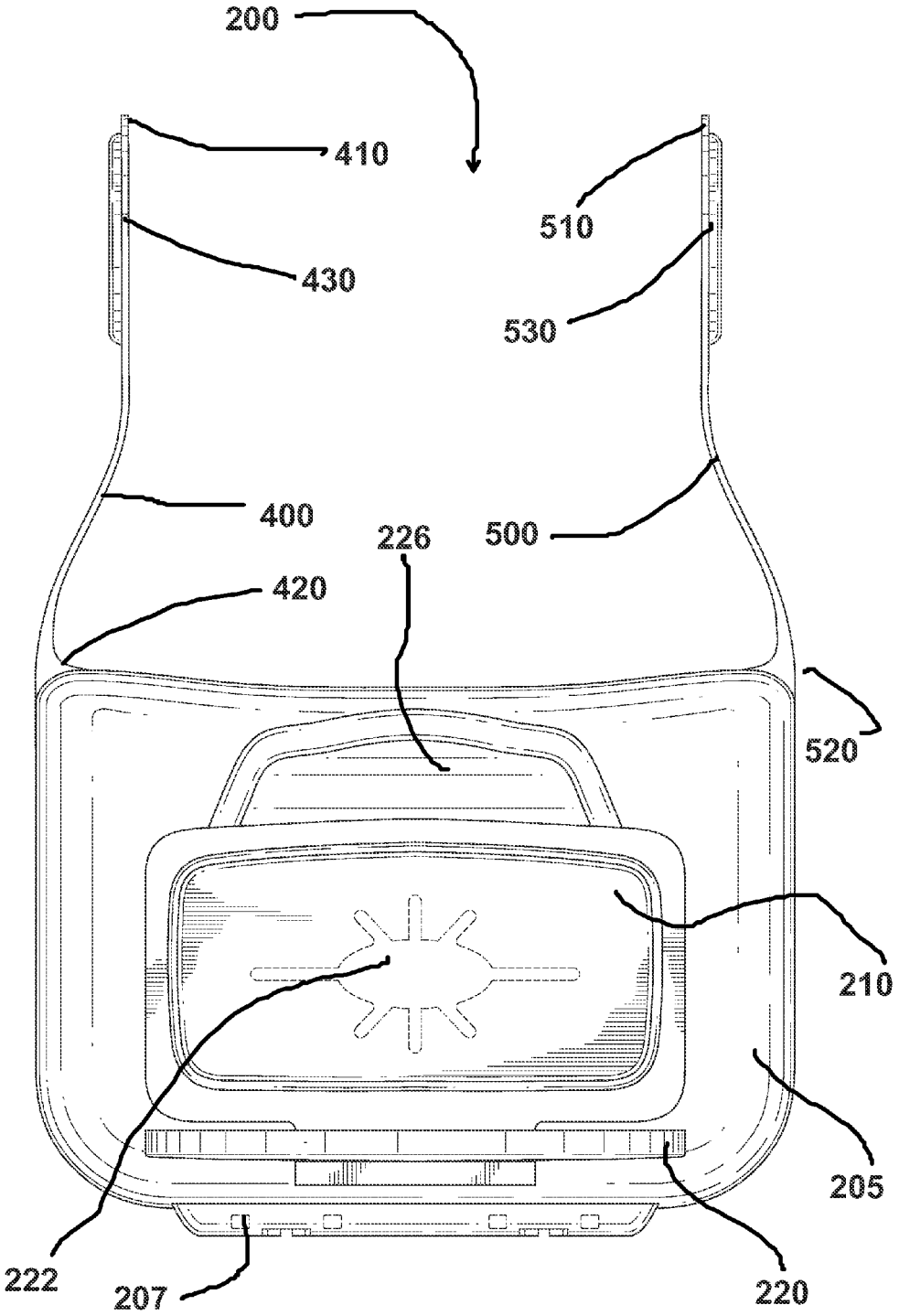
FIG. 17 is a top view dispenser of FIG. 1 with the support arms folded/pivoted out with upper lid open and middle section closed.
Figure 18:
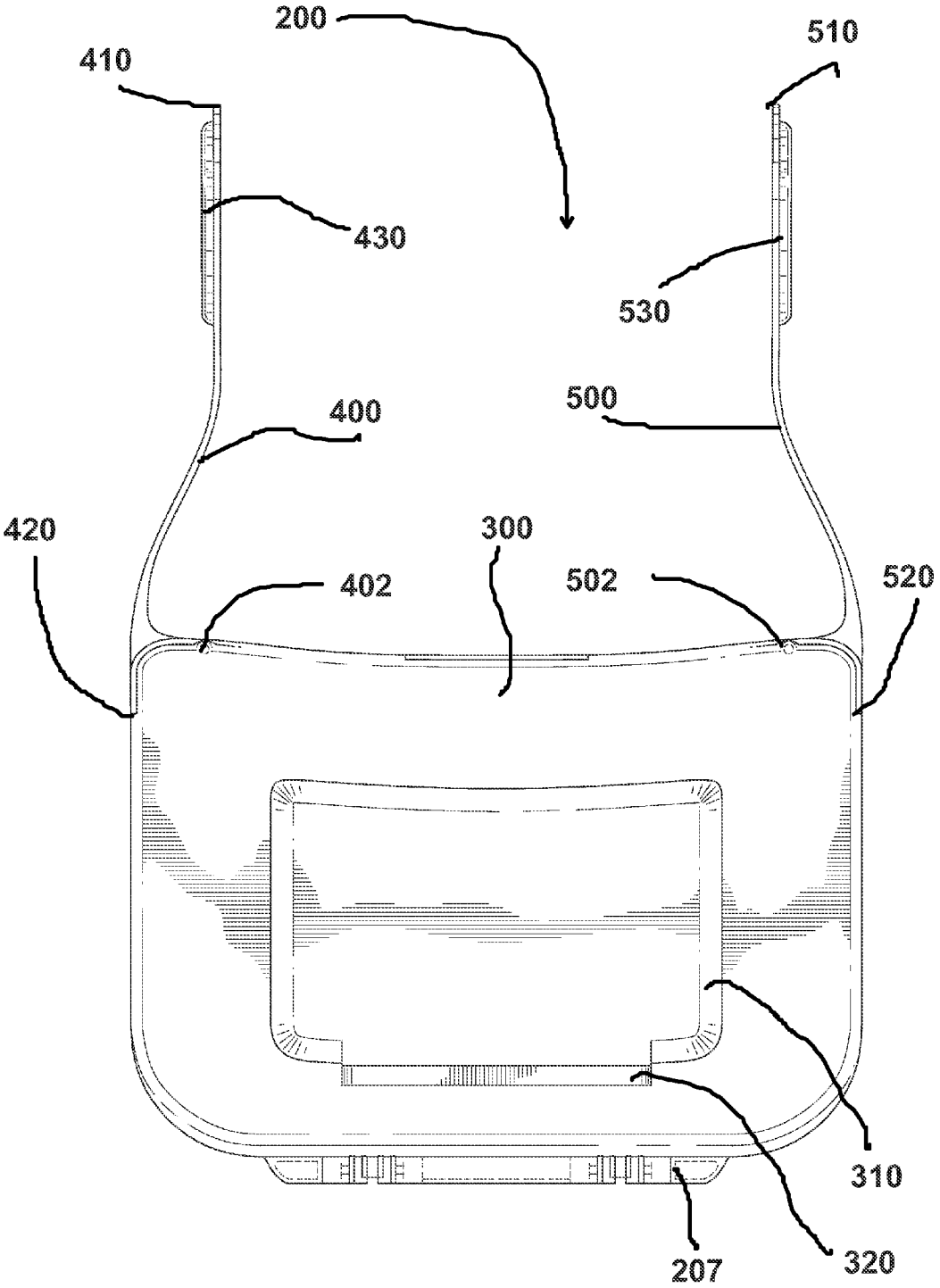
FIG. 18 is a bottom view dispenser of FIG. 1 with the support arms pivoted out with lower spacer pivoted out/extended.

FIG. 3 is a perspective view of conventional toilet paper dispenser 100 with supplemental dispenser 10 attached to the spindle 150, where the supplemental dispenser 10 has been rotated to a non-vertical position and the door 220 opened.

In one embodiment supplemental dispenser 10 can be provided for dispensing pre-moistened or dry tissue sheets 250 from a container housing 200. In one embodiment, various types of sheets 250 can be dispensed from supplemental dispenser 10, such as dry or pre-moistened tissues. In one embodiment, supplemental dispenser 10 can dispense individual stacked interfolded sheets—either dry or pre-moistened. Such stacked configurations for dry or pre-moistened sheets are well known to those of ordinary skill in the art.

Referring particularly to the figures, container housing 200 can have has a configuration with a width and a depth to contain conventionally available pre-moistened wipes. Container housing 200 can include an interior volume 210 in which the tissue sheets 250 are stored and dispensed from. Container housing 200 may take on any shape or configuration, and the rectangular box-type configuration shown in the figures is for illustrative purposes only. Top 205 of container 200 can include dispensing opening 208 (to interior volume 210) which can be sealed/closed by door 220. In different embodiments dispensing opening 208 may be included on any side of container housing 200. For example, in the illustrated embodiment, the dispensing opening 208 is shown on the top 205. In various embodiments dispensing opening 208 may take on any suitable shape or configuration.

The container housing 200 may be formed of any conventional material, and may be a relatively inexpensive plastic disposable material, paperboard material, paper, cardboard, and the like. It may be desired to form the container housing 200 of a liquid impermeable material if it is desired to contain and dispense premoistened tissue sheets 250. In one embodiment, container housing 250 may be formed of any type of material, including a liquid absorbent, and the pre-moistened tissue sheets 250 may be encased in a liquid impermeable film. Alternatively, interior volume 210 may be lined with the film. The premoistened sheets 250 may be provided in a refill package or cartridge that may be placed into the interior volume 210, the refill package including the liquid impermeable film. In this configuration, the container 200 can have a resealable wall, lid, or other member that may be opened to allow a refill cartridge of tissues to be inserted into the interior volume 210.

It may further be desired that interior volume 210 include a door 220 over a dispensing opening 208. In the case of pre-moistened sheets 250, door 220 may be hinged with hinge 224 and when door 220 is closed, it prevents significant loss of moisture from sheets 250 and prevents undesired drying out. In one embodiment door can be snap closed on top 205 with lock 226. In on embodiment door 220 can be frictionally locked with a rim of opening 208.

In one embodiment supplemental dispenser 10 can be supported on toilet paper dispenser 100 by a plurality of arms 400,500. In one embodiment the support arms 400,500 can be foldably connected to container 200 by hinges 402,502.

In one embodiment supplemental dispenser 10 can be attached to a conventionally available toilet paper dispenser 100 having a roll of toilet paper 170. Such fixtures 100 are well known and a typical fixture 100 is shown in FIGS. 1 through 3, with a frame 110, support arms 120, and recesses 130, along with a telescoping spindle 150. Each of the support arms 120 typically includes a recess 130. A conventional spindle 150 having tabs 160 on each end is typically inserted through a hollow core of a roll of toilet paper 170 (not shown) and received in the recesses 130.

Figure 19:
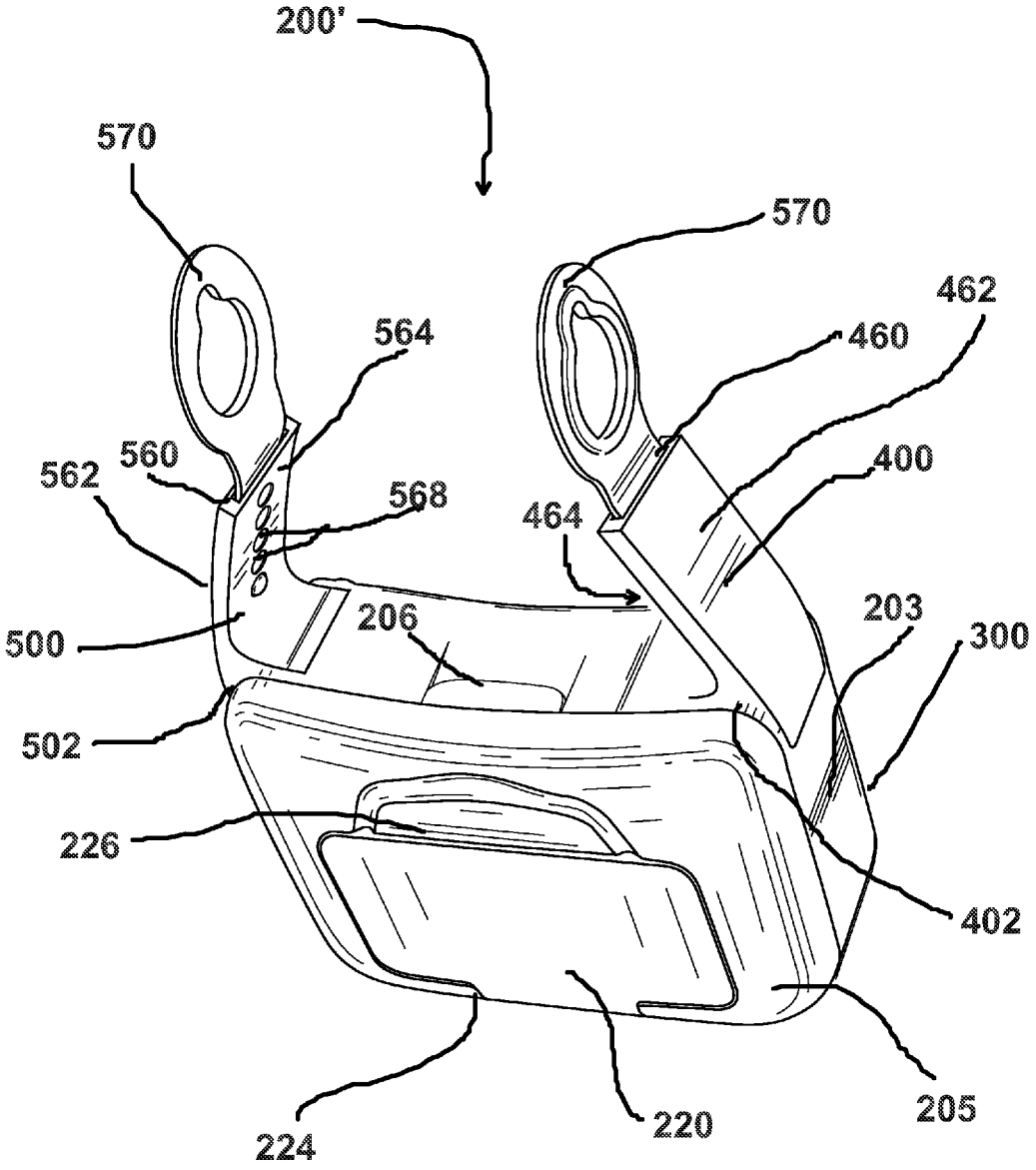
FIG. 19 is a perspective view of an alternative version of a supplemental dispenser with folding/pivoting arms which arms are also telescopically extendable to vary the depth from which the dispenser will hang vertically from a spindle of a toilet paper dispenser.

FIG. 19 is a perspective view of an alternative version of a supplemental dispenser 200' with folding/pivoting arms 400,500 which arms are also telescopically extendable (respectively via telescoping sections 470,570) to vary the depth from which the dispenser will hang vertically from a spindle 150 of a toilet paper dispenser 100.

FIG. 20 is a schematic view of one of the arms 500 shown in FIG. 19 taken from the external side of the arm 500. FIG. 21 is a side view of arm 500 taken from the internal side, where arm 500 is in a retracted position (with telescoping section 570 in its lowermost position) and locked in place in such retracted position (via locking button 574 locking into the lowermost opening of plurality of openings 568), and schematically the length of such upper portion is indicated as L1. FIG. 22 is a side view of arm 500 taken from the internal side, where telescoping section 570 arm is in an extended position and locked in place in such extended position (via locking button 574 locking into the uppermost opening of plurality of openings 568), and schematically the length of such upper portion is indicated as L2 where L2 is larger than L1. Any intermediate telescoping position for telescoping section 570 can be selected via locking button 574 into one of the intermediate openings of plurality of openings where the length of such upper section will be between L1 and L2. Arm 400 can be constructed substantially similar to arm 500.

Figure 23:
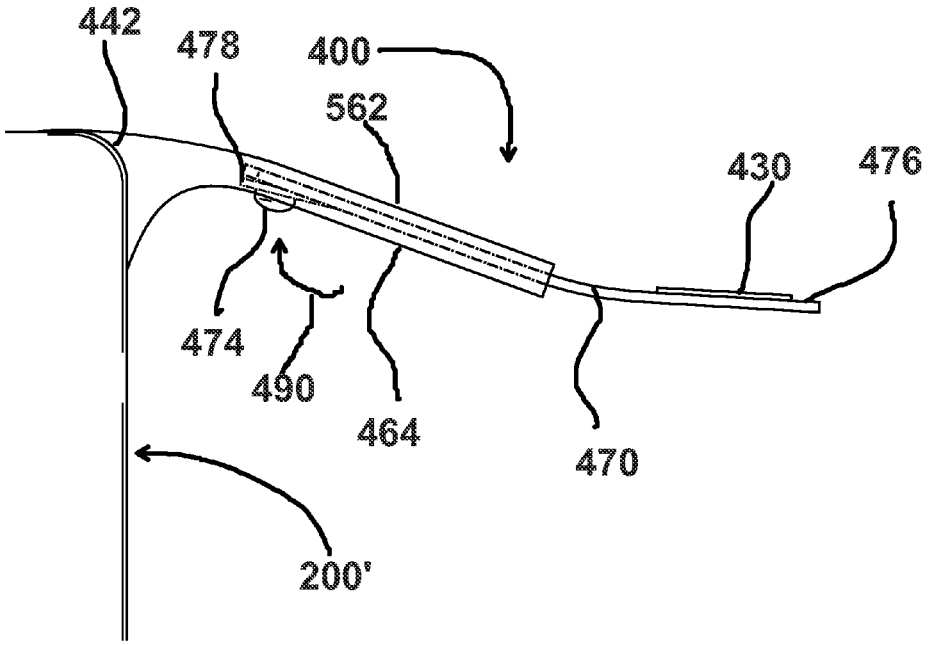
FIG. 23 is a top view of one of the arms in FIG. 19, where the arm is in a retracted position and locked in place in such retracted position.
Figure 24:
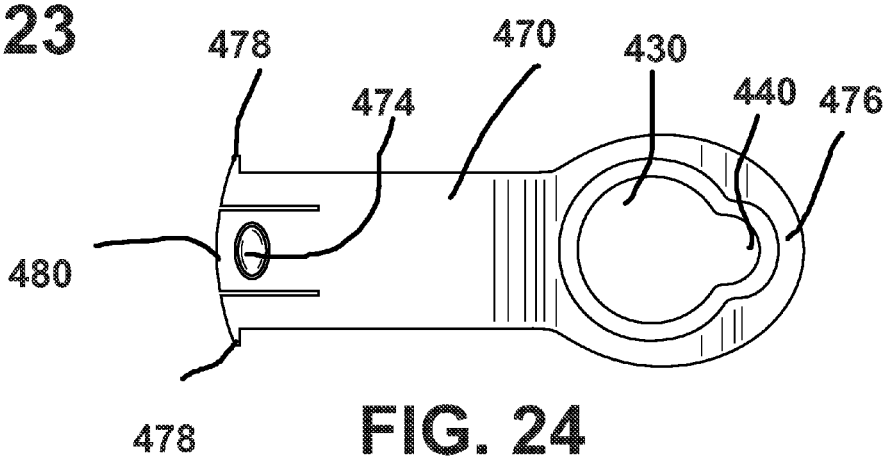
FIG. 24 is an internal side view of the telescoping section of the arm shown in FIG. 23.
Figure 25:
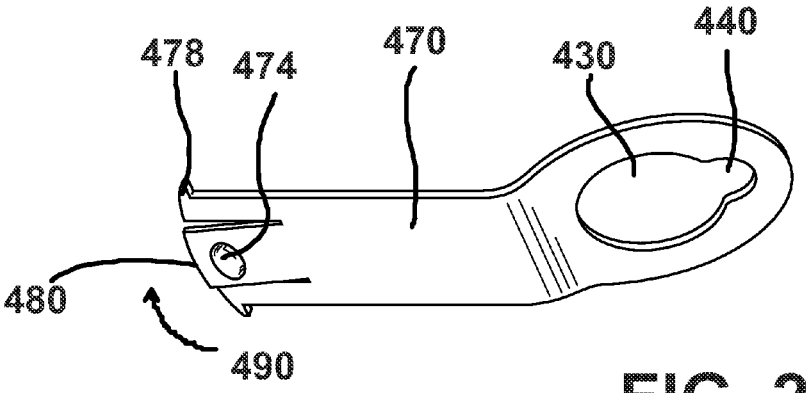
FIG. 25 is a perspective view of the telescoping section of the arm shown in FIG. 23.

FIG. 23 is a top view of arm 400, where telescoping section 470 arm is in a retracted position and locked in place in such retracted position (via locking button 474 locking into the lowermost opening of plurality of openings 468). Arrow 490 schematically indicates that locking button 474 can be pushed in to unlock arm and move to another position. FIG. 24 is an internal side view of the telescoping section 470 of arm 400, and FIG. 25 is a perspective view of the telescoping section 470. Telescoping section 470 can include second end 476, locking button 474, and stopping tables 478. Locking button 474 can be biased outside of telescoping section via biased section 480.

Figure 26:
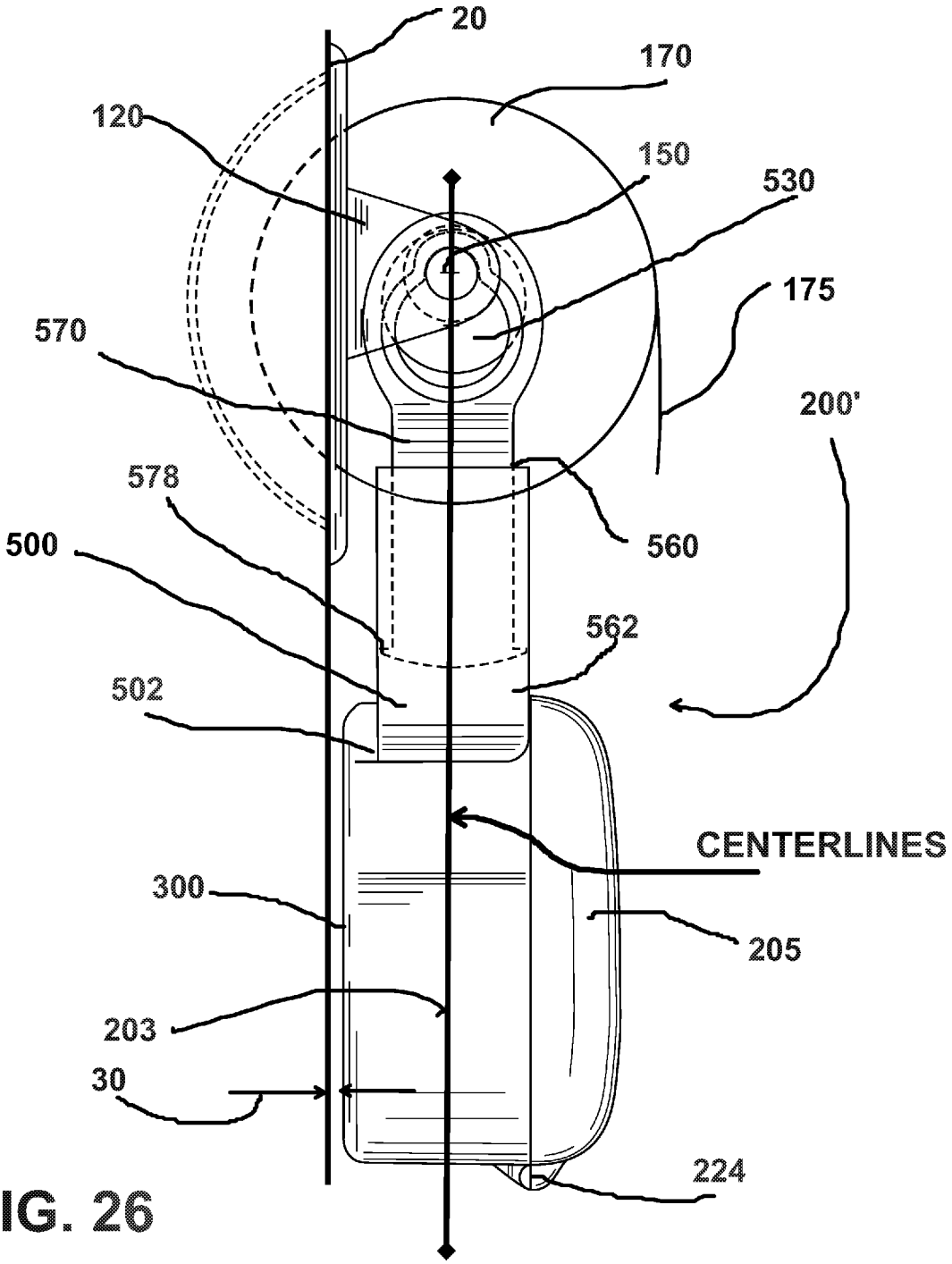
FIG. 26 is a side view of the alternative supplemental dispenser of FIG. 19 with folding arms attached to and hanging vertically from a spindle of a toilet paper dispenser.

FIG. 26 is a side view of the alternative supplemental dispenser 200' with folding arms 400,500 attached to and hanging vertically from a spindle 150 of a toilet paper dispenser 100. Gap 30 indicates the distance between dispenser bottom 30 and wall 20. The distance of the upper section of container 200 to the bottom of the roll of toilet paper 170 can be varied by changing the amount of telescoping (e.g., L1, L2, or some other length) of the two telescoping sections 470 and 570.

Figure 27:
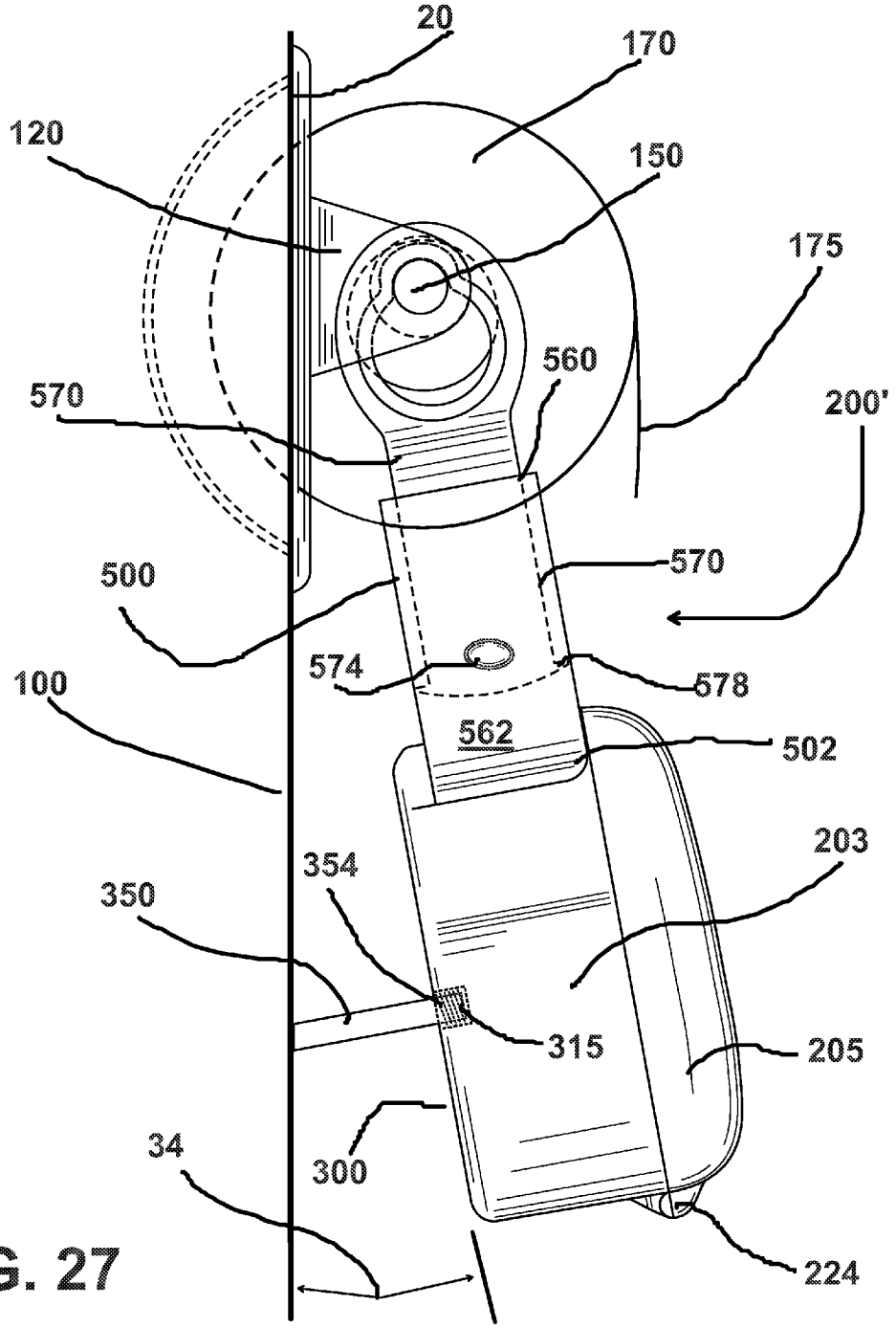
FIG. 27 is a side view of the alternative supplemental dispenser of FIG. 19 with folding arms attached to and hanging vertically from a spindle of a toilet paper dispenser, and a spacer being attached to place the dispenser in a non vertical position relative to the wall.

FIG. 27 is a side view of alternative supplemental dispenser 200' with folding arms 400,500 attached to and hanging from a spindle 150 of a toilet paper dispenser 100, and a positioning arm/spacer 350 being attached to place the dispenser container 200' in a non vertical position relative to the wall as schematically indicated by angle 34. Positioning arm 350 can be threaded to container 200'

The following is a list of reference numerals:

LIST FOR REFERENCE NUMERALS

| (Part No.) | (Description) |
|---|---|
| 10 | method and apparatus |
| 20 | wall |
| 30 | gap |
| 34 | angle |
| 100 | toilet paper dispenser |
| 110 | frame |
| 120 | pair of posts or bracket members |
| 124 | line parallel to longitudinal axis |
| 126 | rotation arrow |
| 130 | aperture, socket, recess, or bore |
| 150 | spindle |
| 152 | first portion |
| 154 | second portion |
| 156 | spring |
| 160 | unitary stub-shaft extremities |
| 170 | roll of toilet paper |
| 175 | sheet of toilet paper |
| 200 | container |
| 202 | interior volume |
| 203 | bottom section |
| 205 | top section |
| 206 | top lock |
| 207 | top hinge |
| 210 | recessed area in top section |
| 220 | door |
| 222 | opening in top of container |
| 224 | hinge for door |
| 226 | lock for door |
| 250 | plurality of sheets (wetted or dry) |
| 255 | individual moistened sheet |
| 300 | bottom |
| 310 | recessed portion |
| 315 | threaded socket |
| 320 | positioning bracket |
| 330 | hinge |
| 350 | positioning arm |
| 354 | threaded area |
| 400 | arm |
| 402 | hinge |
| 410 | first end |
| 420 | second end |
| 430 | central bore or socket |
| 440 | smaller notch |
| 450 | length |
| 454 | thickened portion |
| 460 | aperture |
| 462 | outer wall |
| 464 | inner wall |
| 468 | plurality of openings |
| 470 | telescoping section |
| 474 | locking button |
| 476 | second end |
| 478 | stopping tabs |
| 480 | biased section |
| 490 | arrow |
| 500 | arm |
| 502 | hinge |
| 510 | first end |
| 520 | second end |
| 530 | central bore or socket |
| 540 | smaller notch |
| 550 | length |
| 554 | thickened portion |
| 560 | aperture |
| 562 | outer wall |
| 564 | inner wall |

-continued

LIST FOR REFERENCE NUMERALS

| (Part No.) | (Description) |
|---|---|
| 568 | plurality of openings |
| 570 | telescoping section |
| 574 | locking button |
| 576 | second end |
| 578 | stopping tabs |
| 580 | biased section |
| 590 | arrow |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A dispenser for storing and dispensing folded tissue sheets, comprising:

(a) a housing having top and bottom portions, an internal compartment configured to retain a supply of folded issue sheets, and an openable top providing access to the internal compartment;

(b) a dispensing opening in the top, providing access to the internal compartment which is smaller than the access in the openable top;

(c) a plurality of first and second arms, located on opposite exterior side walls of the housing and rotatably connected to the housing having closed and open positions, each of the first and second arms including an opening having two opening sizes, a first size and a second size, with each opening size having an opening centerline and each of the opening centerlines of the first arm being parallel to and coincident with each other and each of the opening centerlines of the second arm being parallel to and coincident with each other, the first size being larger than the second size, the openings engage a spindle of a toilet paper fixture; and (d) a spacer connected to the bottom portion, wherein the spacer has extended and retracted states, wherein in the extended state the spacer protrudes beyond the bottom portion and causes the housing to be located in a non-vertical orientation away from a wall from which the dispenser is supported, when the arms are supported by the wall, and in the retracted state the spacer does not protrude beyond the bottom portion, causing the container to be located in a vertical orientation relative to the wall.

2. The dispenser of claim 1, wherein the housing comprises a generally elongated box-like structure having parallel side walls, the arms being rotatable to their closed position to extend substantially parallel to a plane including the top.

3. The dispenser of claim 1, wherein the bottom portion includes a generally planar surface and a recessed portion, which recessed portion generally contains the spacer in a retracted state such that the spacer does not protrude beyond the planar surface of the bottom portion.

4. The dispenser of claim 1, wherein each arm is frictionally positionable, and the housing provides frictional resistance to the roll of toilet paper.

5. The dispenser of claim 1, wherein the plurality of arms in their open position are supported on the toilet paper dispenser having a pair of toilet paper dispenser spaced apart arms and the spindle, the spindle also being supported by the pair of toilet paper dispenser spaced apart arms, a roll of toilet paper being supported by the spindle, and the arms of the dispenser in the open state being attached to the spindle at locations between the roll of toilet paper and the pair of spaced apart toilet paper dispenser arms.

6. The dispenser of claim 1, wherein the dispenser includes a lock operably connected to the openable top of the dispenser, and the spacer in the extended state the spacer maintains the dispenser in a non-vertical position in relation to a wall supporting the toilet paper dispenser.

7. A combination toilet paper fixture and supplemental dispenser for storing and dispensing moistened folded tissue sheets, the supplemental dispenser being supported by the toilet paper fixture having a pair of spaced apart toilet paper fixture arms and a spindle supported between the fixture arms, the spindle supporting a roll of toilet paper, comprising:

(a) the supplemental dispenser includes a housing having an internal compartment having a supply of moistened folded tissue sheets, an openable top providing access to the internal compartment, the internal compartment being sealed to retain moisture in the moistened folded tissue sheets, and a bottom;

(b) a dispensing opening in the top, providing access to the tissue sheets in the internal compartment which dispensing opening is smaller than the access provided by the openable top;

(c) a plurality of extendable and retractable arms, located on opposite exterior side walls of the housing, each of the arms including an opening, the openings engage the spindle of the toilet paper fixture; and (d) a spacer connected to the bottom portion, wherein the spacer has extended and retracted states, and in the extended state the spacer both protrudes beyond the bottom portion of the supplemental dispenser and maintains the supplemental dispenser in a non-vertical position in relation to a wall supporting the toilet paper fixture, wherein each arm includes a curved extension stop and the amount of extension of the arm is limited by the extension stop.

8. The dispenser as in claim 7, wherein the housing comprises a generally elongated box-like structure having parallel side walls, the arms extending substantially parallel to a plane including the top, and the housing provides frictional resistance to the roll of toilet paper.

9. The dispenser as in claim 8, wherein each arm in the extended state has an opening which is located between the parallel side walls.

10. The dispenser as in claim 7, further comprising a supply of folded tissues disposed within the housing, the housing being refillable and openable top for receipt of the supply of tissues.

11. The dispenser as in claim 10, wherein the plurality of extendable and retractable arms include first and second arms, the spindle has a plurality of tabs and each opening of the arms includes two opening sizes, a first size and a second size, the first size being larger than the second size, with each opening size having an opening centerline and each of the opening centerlines of the first arm being parallel to and coincident with each other, and each of the opening centerlines of the second arm being parallel to and coincident with each other, the first opening size engages the spindle and the second opening size engages the tabs of the spindle.

12. The dispenser as in claim 7, further comprising a supply of folded tissues disposed within the housing, the housing being a disposable item after depletion of the supply of tissues.

13. A combination toilet paper dispensing fixture and supplemental dispenser for storing and dispensing moistened folded tissue sheets, the supplemental dispenser adapted for configuration with the toilet paper dispensing fixture with a pair of spaced apart toilet paper fixture arms and having a spindle supported between the fixture arms, the spindle supporting a roll of toilet paper, the supplemental dispenser comprising:

a housing having an internal compartment configured to retain a supply of moistened folded issue sheets, an openable top providing access to the internal compartment;

a dispensing opening in the top, providing access to the internal compartment which is smaller than the access than the openable top;

a plurality arms pivotally connected to the supplemental dispenser having extended and retracted states, the arms being located on opposite exterior side walls of the housing and each including a support opening engaging the spindle of the toilet paper fixture; and a spacer connected to the bottom portion, wherein the spacer has extended and retracted states, and in the extended state the spacer both protrudes beyond the bottom portion of the supplemental dispenser and maintains the supplemental dispenser in a single non-vertical position away from and in relation to a wall supporting the toilet paper fixture, and in the retracted state the supplemental dispenser is oriented in a vertical position relative to the wall.

14. The dispenser as in claim 13, wherein the housing comprises a generally elongated box-like structure having parallel side walls, the arms extending substantially parallel to a plane including the top, wherein each arm includes a curved extension stop and the amount of extension of the arm is limited by the extension stop.

15. The dispenser as in claim 14, wherein each arm in the extended state has an opening which is located between the parallel side walls.

16. The dispenser as in claim 14, each arm is frictionally positionable, and the housing provides frictional resistance to the roll of toilet paper.

17. The dispenser as in claim 13, further comprising a supply of folded tissues disposed within the housing, the housing being refillable and openable top for receipt of the supply of tissues.

18. The dispenser as in claim 13, wherein the plurality of arms include first and second arms, the spindle has a plurality of tabs and each opening of the arms includes two opening sizes, a first size and a second size, the first size being larger than the second size, with each opening size having an opening centerline and each of the opening centerlines of the first arm being parallel to and coincident with each other and each of the opening centerlines of the second arm being parallel to and coincident with each other, the first opening size engages the spindle and the second opening size engages the tabs of the spindle.

* * * * *